US005851446A

United States Patent [19]

Bardo et al.

[11] Patent Number: 5,851,446

[45] Date of Patent: Dec. 22, 1998

[54] RIGID COOLING TOWER

[75] Inventors: Charles J. Bardo, Lake Kiowa; Jesse Q. Seawell; Toby L. Daley, both of Fort Worth; James A. Bland, Rhome; Gregory S. Mailen, Waxahachie, all of Tex.

[73] Assignee: Baltimore Aircoil Company, Inc., Jessup, Md.

[21] Appl. No.: 800,649

[22] Filed: Feb. 4, 1997

Related U.S. Application Data

[63] Continuation-in-part of Ser. No. 711,261, Sep. 9, 1996.

[51] Int. Cl.[6] ..... B01F 3/04

[52] U.S. Cl. ..... 261/111; 52/298; 52/299; 52/656.9; 52/712; 261/DIG. 11

[58] Field of Search ..... 261/DIG. 11, 111, 261/108, 109, 110, 112.1, 112.2; 52/298, 299, 712, 656.9

[56] References Cited

U.S. PATENT DOCUMENTS

| | | | |
|---|---|---|---|
| 4,422,983 | 12/1983 | Bardo et al. | 261/24 |
| 4,543,218 | 9/1985 | Bardo et al. | 261/24 |
| 4,637,903 | 1/1987 | Bardo et al. | 261/24 |
| 4,913,710 | 4/1990 | Reverdv | 52/440 X |
| 4,976,895 | 12/1990 | Bardo | 261/108 |
| 5,028,357 | 7/1991 | Bardo | 261/111 |
| 5,054,197 | 10/1991 | Kato et al. | 29/897.31 |
| 5,155,961 | 10/1992 | Bardo | 52/646 |
| 5,236,625 | 8/1993 | Bardo et al. | 261/24 |
| 5,357,729 | 10/1994 | Schutze | 52/653.2 |
| 5,577,353 | 11/1996 | Simpson | 52/712 |

OTHER PUBLICATIONS

Wood Cooling Tower Drawing and IDS and Comments filed Feb. 7, 1997 in S.N. 08/711,261.

BAC–Pritchard, Inc.—Series 4009 Steel Cooling Towers Brochure, 1984.

Unilite Pultruded Composite Structure Cooling Tower Brochure, 1992.

Ceramic Cooling Tower Company—Ultralite 100 Cooling Towers Brochure, 1992.

Ceramic Cooling Tower—Permalite 200 Brochure, 1989.

Ceramic Cooling Tower Company—Concrete Strucutre Cooling Towers Brochure, 1989.

Ceramic Cooling Tower—Ultralite 600XL & 1000XL Brochure, 1994.

Baltimore Aircoil Company Series 4006 Field Erected Industrial Cooling Towers Brochure, 1994.

Baltimore Aircoil Company Industrial Modular Cooling Towers Brochure, 1993.

(List continued on next page.)

*Primary Examiner*—Richard L. Chiesa
*Attorney, Agent, or Firm*—Edward J. Brosius; F. S. Gregorczyk; Stephen J. Manich

[57] ABSTRACT

A cooling tower is disclosed that is resistant to lateral displacement while minimizing the number and type of parts, and while limiting the amount of horizontal bracing. The cooling tower has a fiber reinforced material skeletal frame. Moment-transferring connections are provided in the connections between the elements of the skeletal frame. The moment-transferring connections between the frame members are made by bonding the joined elements to a mounting plate. The mounting plate may be held in place by mechanical fasteners that bear construction loads until the bonding material cures. The mounting plate, columns, beam and mechanical fasteners define construction joints that are capable of bearing construction loads until the bonding material cures. The mounting plate, columns, beam and cured bonding material define post-construction joints that are capable of transferring moments from the beam to the columns and are capable of bearing post-construction loads on the joints. The post-construction joints may also include the mechanical fasteners. Deflections of beams with the post-construction joints are more like a model beam with moment-transferring joints than a model beam that is simply supported.

22 Claims, 19 Drawing Sheets

OTHER PUBLICATIONS

Ceramic Cooling Tower Company Unilite L–Series Cooling Towers Brochure, 1994.

BAC Pritchard, Inc.—Series 4000 Wood Structure Cross-flow Cooling Tower, 1982.

BAC Pritchard, Inc. Series 4008 Wood Cooling Tower, 1984.

BAC–Pritchard, Inc. Series 7000 Wood Structure Counter-flow Cooling Tower, 1989.

BAC–Pritchard, Inc. Series 7000 Field–Erected Counter-flow Cooling Tower, 1980.

Ceramic Cooling Tower Company—Custom Concrete Towers, Permalite Fiberglass Towers, Ultralite Fiberglass Towers & Unilite Fiberglass Towers Brochure, 1991.

Wood Cooling Tower Drawing, Series 4008, Undated.

RIGID COOLING TOWER

This is a continuation-in-part of U.S. patent application Ser. No. 08/711,261, filed Sep. 9, 1996.

FIELD OF THE INVENTION

The present invention relates to cooling towers, and more particularly, to cooling towers designed to withstand lateral forces of wind, earthquakes and the like.

BACKGROUND OF THE INVENTION

Cooling towers are used to cool liquid by contact with air. Many cooling towers are of the counter-flow type, in which the warm liquid is allowed to flow downwardly through the tower and a counter current flow of air is drawn by various means upward through the falling liquid to cool the liquid. Other designs utilize a cross-flow of air, and forced air systems. A common application for liquid cooling towers is for cooling water to dissipate waste heat in electrical generating and process plants and industrial and institutional air-conditioning systems.

Most cooling towers include a tower structure. This structural assembly is provided to support dead and live loads, including air moving equipment such as a fan, motor, gearbox, drive shaft or coupling, liquid distribution equipment such as distribution headers and spray nozzles and heat transfer surface media such as a fill assembly. The fill assembly material generally has spaces through which the liquid flows downwardly and the air flows upwardly to provide heat and mass transfer between the liquid and the air. One well-known type of fill material used by Ceramic Cooling Towers of Fort Worth, Tex. consists of stacked layers of open-celled clay tiles. This fill material can weigh 60,000 to 70,000 pounds for a conventional size air conditioning cooling tower. Structural parts of a cooling tower must not only support the weight of the fill material but must also resist wind forces or loads and should be designed to withstand earthquake loads.

Due to the corrosive nature of the great volumes of air and water drawn through such cooling towers, it has been the past practice to either assemble such cooling towers of stainless steel or galvanized and coated metal, or for larger field assembled towers, to construct such cooling towers of wood, which is chemically treated under pressure, or concrete at least for the structural parts of the tower.

Metal parts of cooling towers can be corroded by the local atmosphere or the liquid that is being cooled, depending on the actual metal used and the coating material used to protect the metal. Further, such metal towers are usually limited in size and are also somewhat expensive, especially in very large applications such as to cool water from an electric power generating station condenser.

Concrete is very durable, but towers made of concrete are expensive and heavy. Many cooling towers are located on roofs of buildings, and the weight of a concrete cooling tower can present building design problems.

Plastic parts are resistant to corrosion, but plastic parts ordinarily would not provide enough strength to support the fill material and the weight of the tower itself.

Wood has been used for the structural parts of cooling towers, but also has its disadvantages. Wood towers may require expensive fire protection systems. The wood may decay under the constant exposure not only to the environment, but also to the hot water being cooled in the tower. Wood that has been chemically treated to increase its useful life may have environmental disadvantages: the chemical treatment may leach from the wood into the water being cooled. Fiber reinforced plastic has been used as a successful design alternative to wood and metal.

To withstand expected lateral wind and seismic loads, support towers have generally been of two types: shear wall frame structures and laterally braced frame structures. Shear wall frame structures are generally of fiber reinforced plastic or concrete construction, and have a network of interconnected columns and beams. Shear walls are used to provide lateral resistance to wind and earthquake loads. In laterally braced framing structures, the cooling towers are generally made of wood or fiber reinforced plastic beams and columns, framed conventionally for dead load support; diagonal braces are used to resist lateral loads. The joints where the beams and columns meet are designed to allow for rotation between the structural elements. The joints do not provide lateral resistance to loading or racking of the structure.

Prior art solutions using fiber reinforced plastic include those shown in U.S. Pat. No. 5,236,625 to Bardo et al. (1993) and No. 5,028,357 (1991) to Bardo. Both patents disclose structures suitable for cooling towers, but a need remains for a mid-priced structure suitable for use as a cooling tower.

Thus, while prior fiber reinforced plastic tower structures have solved many of the problems associated with wood and metal cooling tower structures, many of the solutions to the problem of resistance to lateral loading have increased the costs of these units. Both the shear wall and laterally braced frames can be labor intensive to build, since there are many parts and many connections to be made. There are a large number of key structural elements, with more complex manufacturing and inventorying of parts, increasing the complexity of construction, and therefore the costs. And while the increased costs can be justified in many instances, a need remains for a lower cost cooling tower structure, and for lower cost cooling tower structures that meet less exacting design criteria where the prior structures go beyond the need.

In fiber reinforced plastic frame structures, one difficulty with the joint between the columns and beams has been that when made with conventional bolts or screws, the beams and columns can rotate with respect to each other. If tighter connections were attempted to be made with conventional bolts or screws, to limit rotation and provide lateral stability without adding diagonal bracing, the fiber reinforced plastic material could be damaged, and the problem worsened as the connecting members degrade the fiber reinforced plastic and enlarge the holes in which they are received.

SUMMARY OF THE INVENTION

The present invention addresses the need to provide cooling towers that are easy to design, manufacture and construct. It also addresses the need for cooling towers that are less expensive to manufacture and simpler to construct than conventional cooling towers. It provides a mid-level cooling tower structure that meets the need for a cooling tower that fulfills less exacting design criteria to lower the cost of the unit. It fulfills the need for lateral stability to withstand anticipated wind and earthquake loads while reducing or eliminating the need for traditional diagonal bracing and while eliminating shear walls. It also allows for an increased span for beams while meeting design criteria for creep and service life, without increased diagonal bracing, while also providing design flexibility for increased service life and reduced creep in beams in cooling towers.

In one aspect the present invention provides a cooling tower comprising a plurality of vertical columns made of a fiber reinforced material, a plurality of first level beams at a first vertical level, and a plurality of second level beams at a second vertical level. Each first level beam and each second level beam is made of fiber reinforced material and extends between a pair of columns. The cooling tower also includes a fluid distribution system for distributing fluid to be cooled within the cooling tower; the fluid distribution system is at the second vertical level. The cooling tower also includes heat transfer material through which air and fluid from the fluid distribution system may pass; the heat transfer material is at the first vertical level. The vertical columns and one of the beams have co-planar surfaces at the junctures of the beam and the vertical columns. There are mounting members at the junctures of the vertical columns and the beam. Each mounting member has a planar mounting surface facing the co-planar surfaces of the beam and the vertical columns. A plurality of mechanical fasteners mount the mounting members to the columns and the beam. Bonding material is disposed between the mounting surfaces of the mounting members and the co-planar surfaces of the columns and beam. The bonding material is of the type that is applied in a first state and that cures to another final cured state. The mechanical fasteners, mounting members, beam and columns define construction joints that are capable of bearing substantially all design construction loads on the joints when the bonding material is in the first state. The mounting members, beam, columns, and cured bonding material define post-construction joints that are capable of bearing substantially all design post-construction loads on the joints.

In another aspect, the present invention provides a cooling tower comprising a plurality of vertical columns made of a fiber reinforced material, a plurality of first level beams at a first vertical level, and a plurality of second level beams at a second vertical level. Each first level beam and each second level beam is made of a fiber reinforced material and extends between a pair of columns. There is a fluid distribution system for distributing fluid to be cooled within the cooling tower; the fluid distribution system is at the second vertical level. There is also a heat transfer material through which air and fluid from the fluid distribution system may pass; the heat transfer material is at the first vertical level. The vertical columns and a plurality of the beams have co-planar surfaces at the junctures of the beams and the vertical columns. Mounting members are at the junctures of the vertical columns and the beams. Each mounting member has a planar mounting surface facing the co-planar surfaces of the beams and the vertical columns. A plurality of mechanical fasteners mount the mounting members to the columns and the beams. Bonding material is disposed between the mounting surfaces of the mounting members and the co-planar surfaces of the columns and beams. The bonding material is of the type that is applied in a first uncured state and that cures to another final cured state. The mechanical fasteners, mounting members, beam and columns define construction joints when the bonding material is in the first uncured state and the mounting members, beam, columns and cured bonding material define post-construction joints. The construction joints are capable of supporting the cooling tower structure during construction and the post-construction joints are capable of supporting the dead load of the cooling tower structure after construction.

In another aspect, the present invention provides a cooling tower comprising a plurality of vertical columns made of a fiber reinforced material; a plurality of first level beams at a first vertical level, and a plurality of second level beams at a second vertical level. Each first level beam and each second level beam is made of a fiber reinforced material and extends between a pair of columns. The tower also includes a fluid distribution system for distributing fluid to be cooled within the cooling tower; the fluid distribution system is at the second vertical level. There is heat transfer material through which air and fluid from the fluid distribution system may pass; the heat transfer material is at the first vertical level. The vertical columns and one of the beams have co-planar surfaces at the junctures of the beam and the vertical columns. There are mounting members at the junctures of the vertical columns and the beam. Each mounting member has a mounting surface that faces the co-planar surfaces of the beam and the vertical columns. There are a plurality of mechanical fasteners mounting the mounting members to the columns and the beam. Bonding material is disposed between the mounting surfaces of the mounting members and the co-planar surfaces of the columns and beam. The bonding material is of the type that is applied in a first uncured state and that cures to another final cured state. At dead loads, the amount of any deflection of the beam bonded to the mounting members with cured bonding material is more similar to the amount of deflection of a model beam with moment-transferring joints than to the amount of deflection of a model beam with simple supports.

DETAILED DESCRIPTION

The present invention may have the structure, functions, results and advantages described in U.S. patent application Ser. No. 08/711,261, entitled "Rigid Cooling Tower", filed Sep. 9, 1996 by the same inventors as the present application, and may be made as described in that patent application, which is incorporated by reference herein in its entirety.

Figure 1:
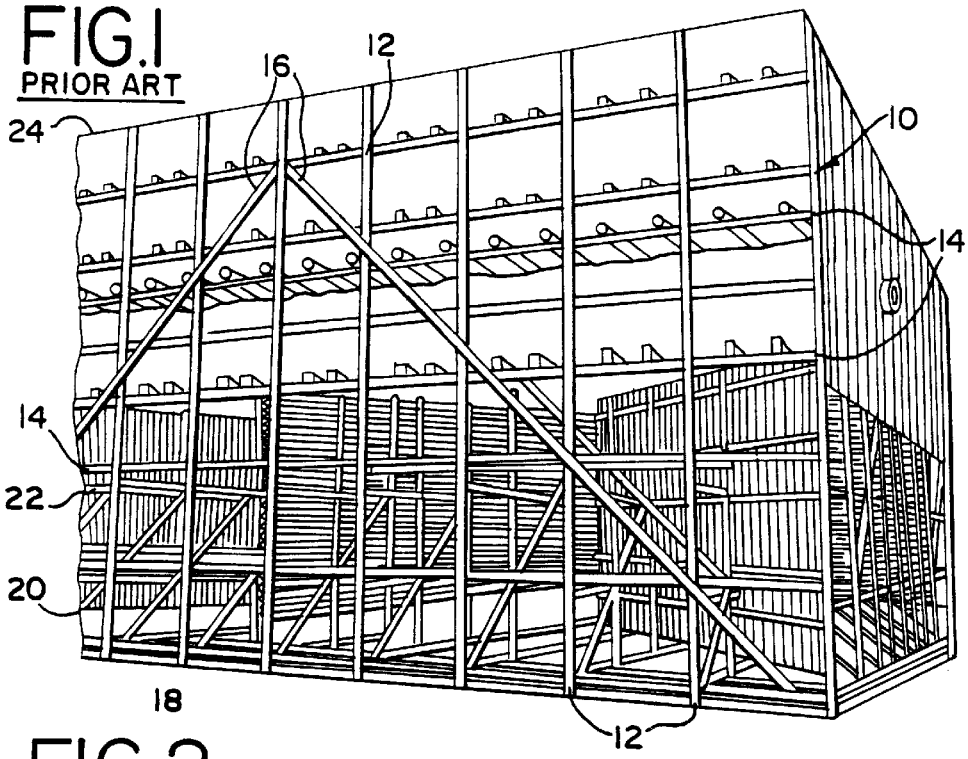
FIG.1 PRIOR ART
FIG. 1 is a partial perspective view of a prior art skeletal frame for a cooling tower, with parts removed for clarity of illustration.
Figure 2:
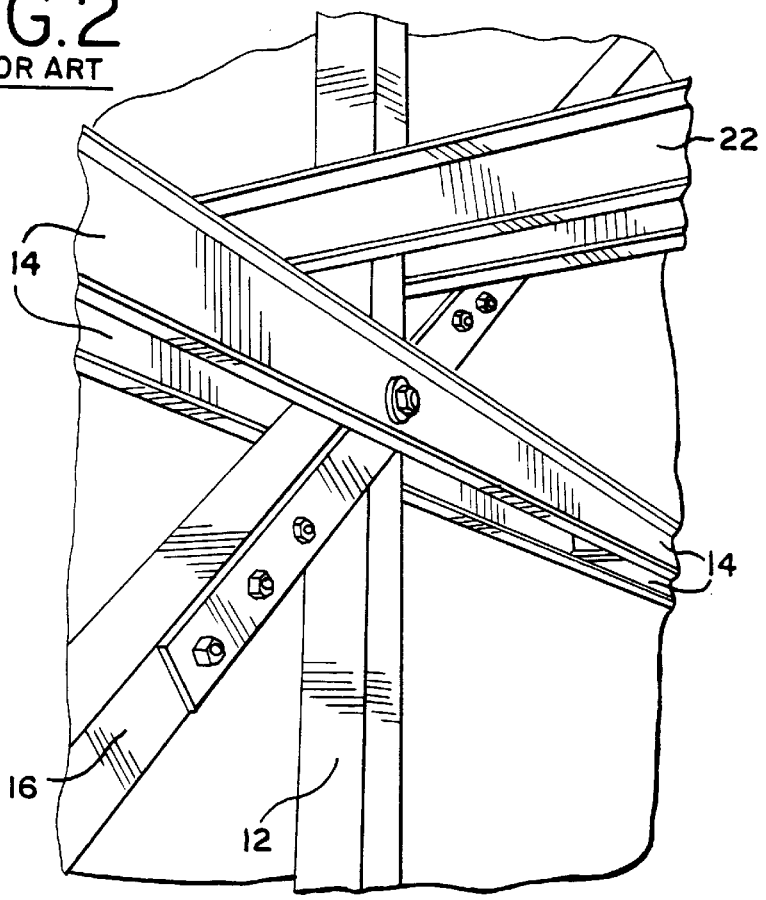
FIG.2 PRIOR ART
FIG. 2 is an enlarged partial perspective view of parts of a prior art skeletal structure such as that shown in FIG. 1, showing intersections of a column with horizontal beams and diagonal braces.

A sample of a prior art cooling tower frame structure is shown in FIGS. 1–2. As there shown, the cooling tower frame generally designated 10 includes a plurality of vertical columns 12 and horizontal beams 14. Typical prior art cooling tower frame columns 12 and beams 14 have been made of either wood or fiber reinforced plastic, and have had a plurality of diagonal bracing members 16 to provide lateral stability and resistance to wind and earthquakes. The structure illustrated in FIG. 1 is an incomplete cooling tower, with parts removed for clarity, to illustrate a typical overall structure in the prior art. A typical framework of diagonal braces is illustrated in FIG. 2, with diagonal beams 16 connected end to end and connected to various structural elements of the support frame at various locations.

In such a typical prior art structure, the columns 12 are spaced apart a distance of about six feet; in the illustrated prior art frame 10, the columns are spaced to provide bays 18, each bay having a width of about six feet. The frame structure 10 has several tiers or levels, the first ground level being the air inlet level 20, with upper levels 22 being vertically aligned with the air inlet level 20. The upper levels 22 are for carrying the fill material, the water distribution system, and the air intake equipment. Generally, in such counterflow structures, a large diameter fan and motor (not shown) are mounted on the roof 24 to draw air up from the air intake level 20 and through the upper levels 22 to exit at the fan.

As shown in FIGS. 1–2, such prior art structures have conventionally required diagonal bracing 16 at each level of the structure. Although other patterns of diagonal bracing than that shown in FIG. 1 could be and have been used, the bracing has generally been provided in pairs so that one set of braces is in tension while the other is in compression when the frame is subjected to lateral forces such as those resulting from winds and earthquakes. And the bracing has also been provided on other sides of the frame, and within the interior of the frame, to protect the frame from lateral forces coming from other directions. Unless some other form of protection against lateral forces is provided, diagonal bracing has generally been provided at and between each level of the frame, from the base to the top beam.

Figure 4:
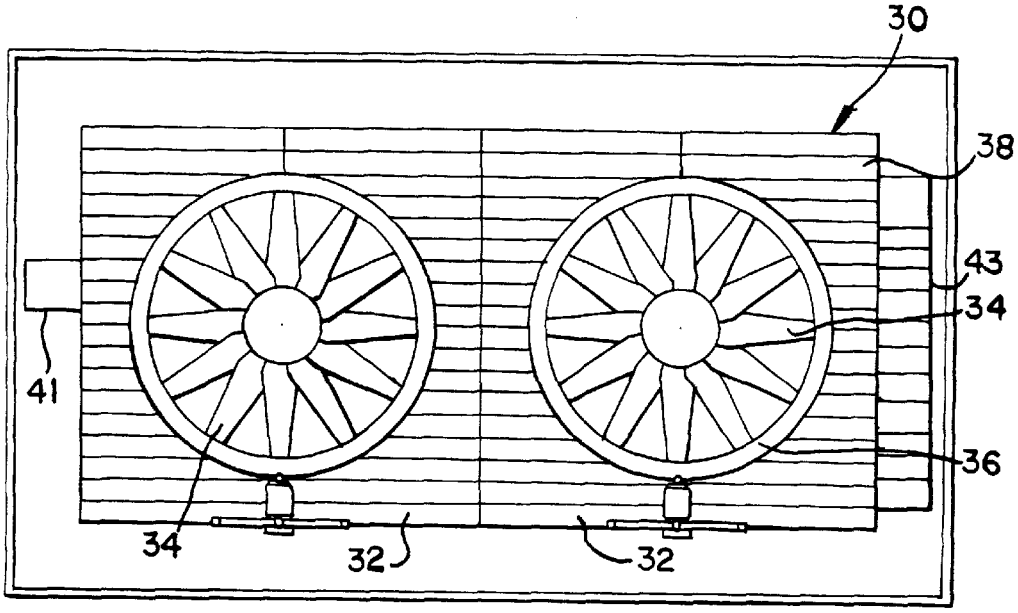
FIG. 4 is a top plan view of the two-cell cooling tower of FIG. 3.
Figure 3:
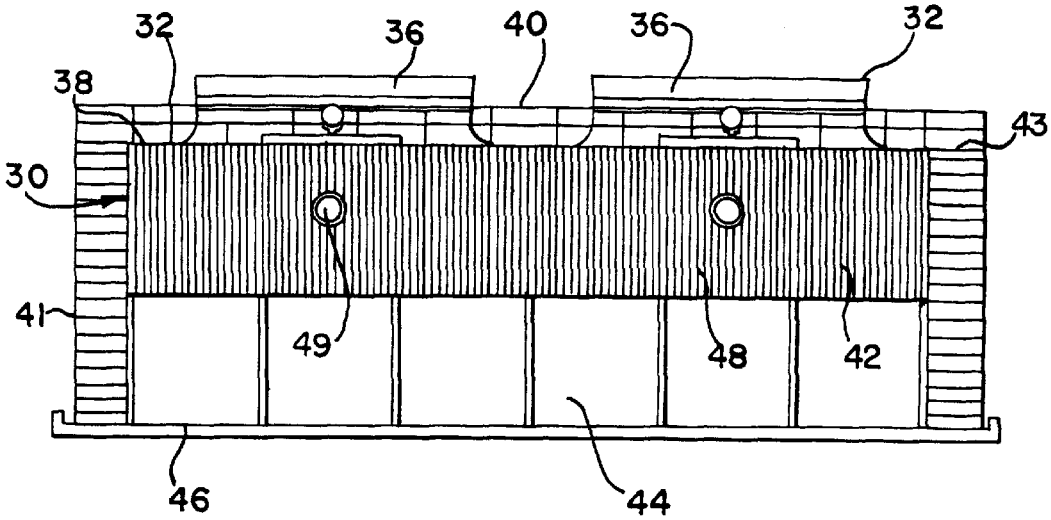
FIG. 3 is a side elevation of a two-cell cooling tower made according to the present invention.

A cooling tower according to the present invention is shown in FIGS. 3–4. It should be understood that the cooling tower shown in FIGS. 3–4 and the structures shown throughout the remainder of the drawings and described herein represent examples of the present invention; the invention is not limited to the structures shown and described. In the embodiment of FIGS. 3–4, the cooling tower, generally designated 30, comprises two connected cells 32. In the illustrated embodiment, each cell is a square about thirty-six feet on each side, so the entire cooling tower is about thirty-six by seventy-two feet. Each cell includes a fan 34 held within a fan shroud 36 that may generally comprise a fiber reinforced plastic structure that is assembled on top of the cooling tower 30. The fan 34 sits atop a geared fan-speed reducer which itself receives a drive shaft extending from a fan motor. The fan, fan speed reducer and motor may be mounted as conventional in the art, as for example, mounting on a beam such as a steel tube or pipe of appropriately chosen structural characteristics such as bending and shear strength and torsion resistance. The motor and beam may be outside of the roof or top of the cooling tower or within it.

In the illustrated embodiment, the fan shroud 36 is mounted on top of a flat deck 38 on top of the cooling tower with a guard rail 40 around the perimeter. A ladder 41 or stairway 43 may also be provided for access to the deck, and walkways may also be provided on the deck.

Beneath the deck 38 are the upper levels 42 of the cooling tower and beneath the upper levels 42 is the bottom or air intake level 44. Beneath the air intake level 44 is a means for collecting cooled water from the fill system. In the illustrated embodiment, the collecting means is a basin 46, into which cooled water drips and is collected.

The exterior of the upper levels 42 may be covered with a casing or cladding 48 that may be designed to allow air to pass through into the cooling tower during, for example, windy conditions, and may be designed to be sacrificial, that is, to blow off when design loads are exceeded. The cladding may be made of fiber reinforced plastic or some other material and may comprise louvers.

Figure 5:
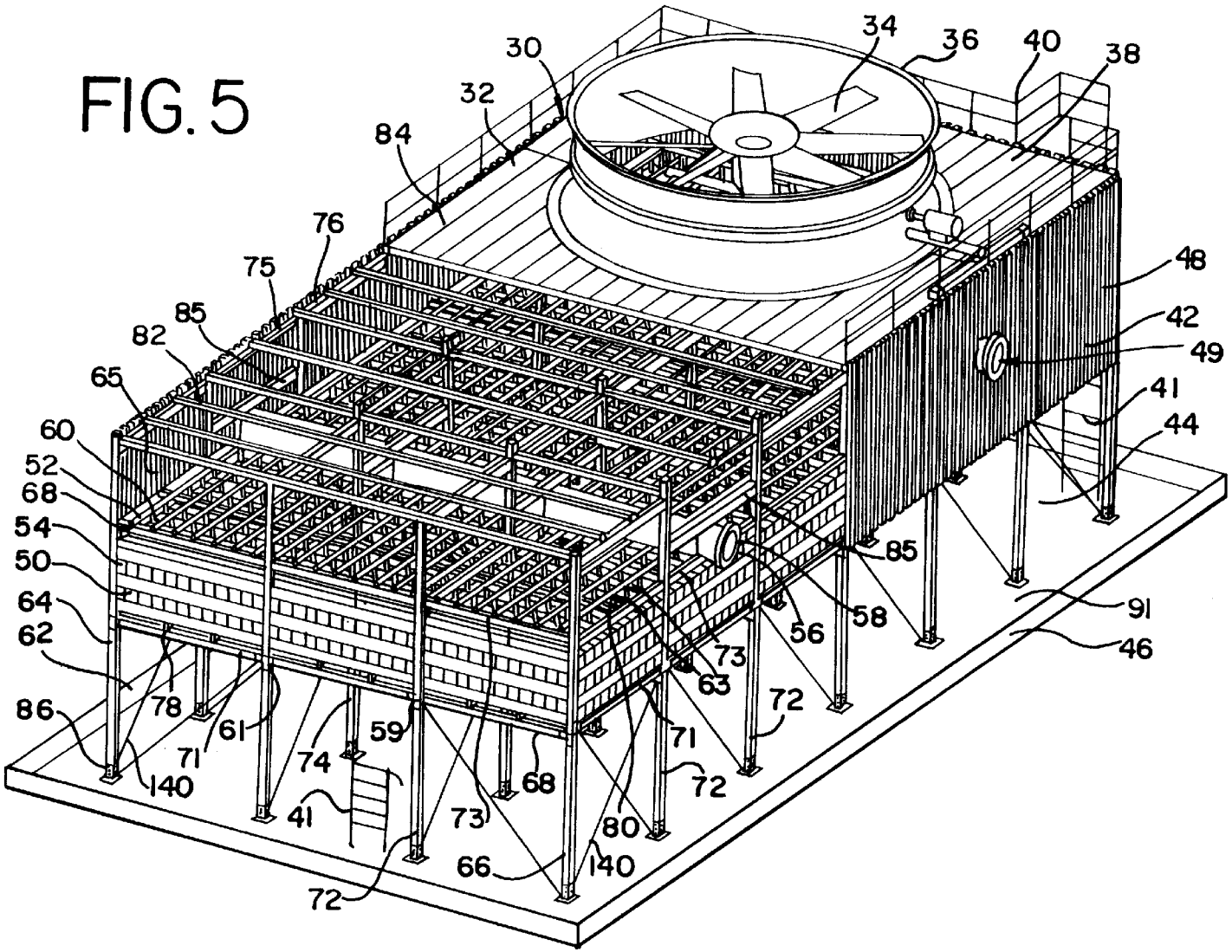
FIG. 5 is a perspective view of another two-cell cooling tower with parts removed for clarity of illustration.

As shown in FIG. 5, the upper levels 42 include a fill or heat transfer level 50 and water distribution level 52. The fill or heat transfer level is below the water distribution level, so that water is distributed to drip through the fill or heat transfer level to the collecting basin 46 below. Air is moved through the fill or heat transfer level past the water to cool it. The illustrated fan 34 comprises one possible means for causing air to move through the fill or heat transfer system, although other means can be used; for example, a blower could be used in a cross-flow arrangement.

The fill or heat transfer level 50 is filled with heat transfer material or media. The heat transfer material may be fill material 54, as shown, although the term heat transfer material may comprise heat transfer coils or splash boards or any other heat transfer media, for either direct or indirect heat transfer, or combinations of such media. Generally, the illustrated fill is open-celled material that allows water to pass downwardly and air to pass upwardly, with heat transfer taking place between the water and air as they pass. Open celled clay tile may be used, as well as open cell polyvinyl chloride materials and any other open cell heat transfer media. In the illustrated embodiment, blocks of multiple generally corrugated vertical sheets of polyvinyl chloride are used as the fill material. Commercially available fill material may be used, such as, for example: fill material previously sold by Munters Corp. of Ft. Myers, Fla. under the designations 12060, 19060, 25060; fill material sold by Brentwood Industries of Reading, Pa. under the designations 1200, 1900, 3800, and 5000; fill material sold by Hamon Cooling Towers of Bridgewater, N.J. under the designations "Cool Drop" and "Clean Flow"; and grid-type fill materials; these fill materials are identified for purposes of illustration only, and the invention is not limited to use of any particular type of fill. The present invention is also applicable to cross-flow designs, and suitable fill arrangements for such designs may be made by those skilled in the art.

The water distribution system 49 in the level 52 above the fill level 50 includes a distribution header 56 that receives hot water from a supply pipe (not shown) which may be connected to the inlet 58 on the exterior of the cooling tower. One distribution header 56 extends across the width of each cell, and each is connected to a plurality of lateral distribution pipes 60 extending perpendicularly from the header 56 to the opposite edges of each cell. The lateral distribution pipes are spaced evenly across each bay 62, with eight lateral distribution pipes being provided in each of the six by six foot bays of the illustrated embodiment. Larger bays may be provided with an appropriate number and spacing of water distribution pipes provided.

Each lateral distribution pipe 60 has a plurality of downwardly directed spray nozzles 63 connected to receive hot water and spray it downward in drops onto the fill material 54, where heat exchange can occur as gravity draws the water drops down to the basin and the fan draws cool air up through the cooling tower. Each lateral distribution pipe may have, for example, ten nozzles, so that there may be eighty nozzles in each bay 62. This water distribution system 49 is shown and described for purposes of illustration only; other designs may also be useful.

The cooling tower of the present invention also has a skeletal support frame 64 to support the fan system, water distribution system 49 and fill material 54. The skeletal support frame 64 defines an interior volume 65 within which the fill material 54 and substantial portion of the water distribution system 49 are held. The skeleton or frame 64 of the present invention comprises a plurality of vertical columns 66 and horizontal beams 68. They are all simply shaped: elongate tubes with square or rectangular horizontal cross sections and flat faces, 67, 69, as shown in FIGS. 13–16. The surfaces 67, 69 of the columns 66 and beams 68 are co-planar at their junctures or intersections 61. The horizontal beams are attached to the columns in a novel manner, so that the completed frame is rigid, and so that the upper levels may be free from diagonal bracing, simplifying construction and lowering the cost of building this field erected tower.

The illustrated columns 66 and beams 68 of the skeletal support frame 64 are all made of a material containing glass fibers or some other reinforcing fiber. The illustrated fiber reinforced material is a pultruded fiber reinforced plastic, and may be made of either fire resistant or non-fire resistant materials, as will be understood by those in the art. Pultruded fiber reinforced plastic parts are generally those produced by pulling elongate glass or other reinforcing fibers through a die with a bonding material and allowing the elongate fibers and bonding material to set. Reinforcing fibers other than glass may be used, and the material containing the reinforcing fibers may be any conventional plastic or resin or other conventional material or matrix as will be understood by those in the art.

Figure 6:
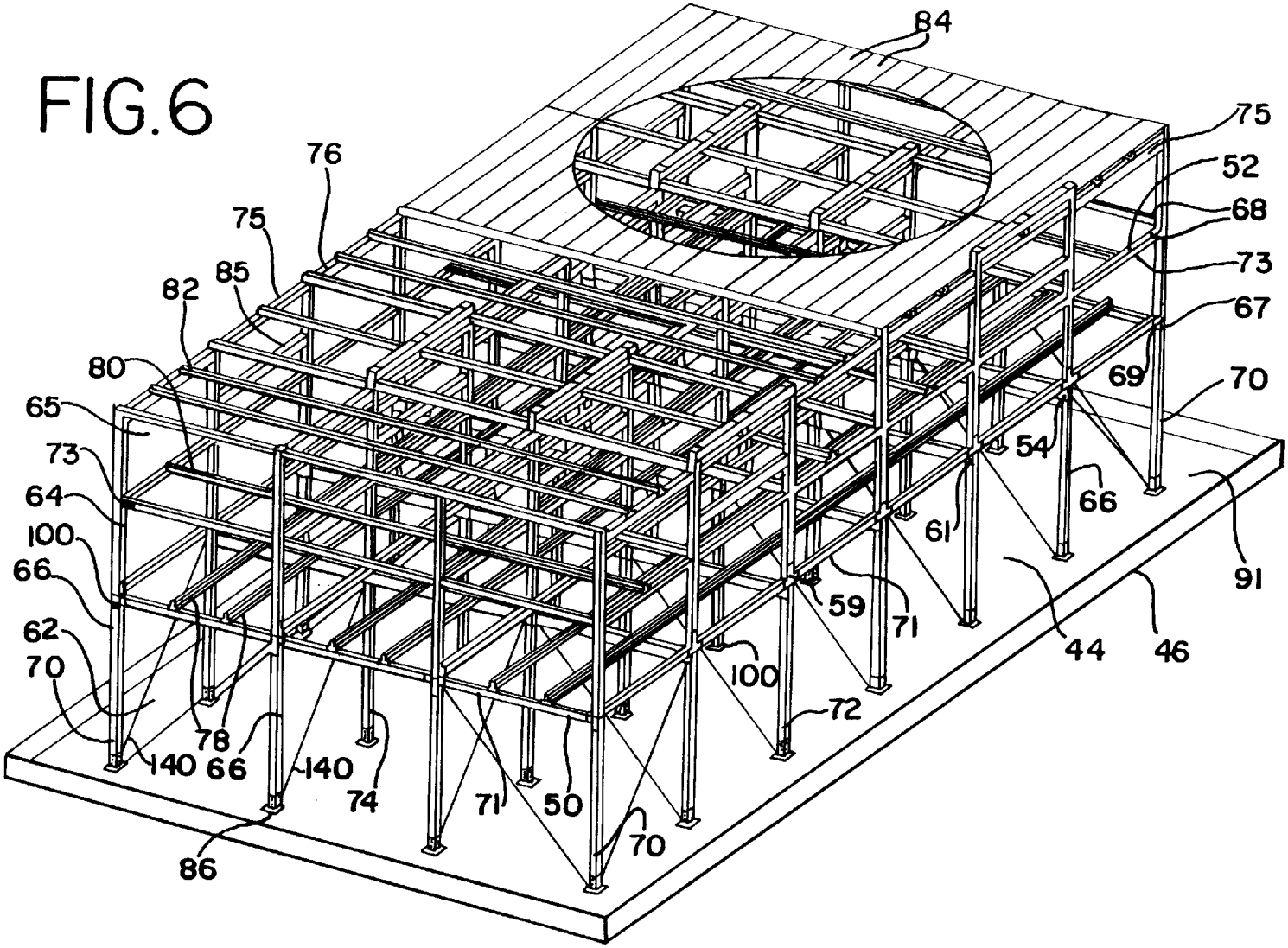
FIG. 6 is a perspective view of the two-cell cooling tower of FIG. 5 with parts removed for clarity of illustration.

As shown in FIG. 6, at each of the four corners of the cooling tower, each corner column 70 is connected to two first level horizontal beams 71 at the fill or first vertical level 50. The vertical end face columns 72 are each connected to three first level horizontal beams 71, and the interior vertical columns 74 are each connected to four first level horizontal beams 71. This first level of horizontal beams 71 supports the fill material 54 at the fill level 50, spaced above the basin 46. These vertical columns are connected to the same number of second level horizontal beams 73 at the next higher water distribution level 52 and to the same number of third level horizontal beams 75 at the next higher deck support level 76. Each successive level of beams is spaced vertically above the preceding levels.

To support the fill material 54 on the fill level 50, the invention includes a plurality of horizontal fill support lintels 78 extending between and supported by parallel first level horizontal beams 71. The fill support lintels 78 are all on the same plane, and the blocks of fill material 54 may be supported between and on adjacent lintels 78 and adjacent lintels and parallel horizontal beams 71. The elevations of the first horizontal beams 71 are set so that the beams on which the lintels rest are slightly below the first level horizontal beams that are perpendicular to the beams on which the lintels rest so that the tops of the lintels are in the same plane as the tops of the first level beams parallel to the lintels, as seen in FIGS. 5 and 6. The lintels may be secured in place with removable tech screws inserted through the lintels into the underlying horizontal beams.

At the next level, a separate system of water distribution support lintels 80 is provided at the second or water distribution support level 52, which is the second vertical level. The water distribution support lintels 80 are perpendicular to the lateral distribution pipes 60 and extend between and are supported by second level horizontal beams 73. In the illustrated embodiment, the water distribution support lintels 80 are perpendicular to the fill support lintels 78 and support the lateral distribution pipes and nozzles above the fill. The perpendicular second level horizontal beams 73 may be set at two levels, so that the tops of the lintels are in the same plane with the second level beams parallel to the lintels.

A separate system of deck support lintels 82 is provided above and spaced from the water distribution support lintels 80 at the deck support level 76. The deck support lintels 82 are supported on the third level horizontal beams 75 and may support the decking planks 84 and the fan 34 and fan shroud 36. The perpendicular third level horizontal beams 75 may be set at different elevations so that the tops of the lintels are in the same plane with the tops of the beams that are parallel with the lintels.

The water distribution header 56 may be supported from underneath by one of the second horizontal beams 73. Alternatively, it may be desirable to provide additional, thicker horizontal suspension beams 85 between the two vertical columns between which the water distribution header 56 runs. With such a construction, instead of supporting all of the weight of the header at one point at the center of the horizontal beam beneath the header, the weight can be suspended from two points spaced from the center, creating less opportunity for the lower beam to creep. This suspension could be from two bolts or pins extending through the beam and through a strap surrounding the header. A portion of the remainder of the water distribution system 49 may be supported by the second level horizontal beams 73.

Figure 7:
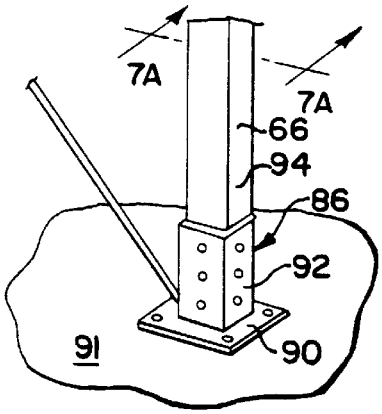
FIG. 7 is an enlarged partial perspective view of the bottom end of a column with one embodiment of a footing that may be used with the present invention.

In the illustrated embodiment, the concrete collecting basin 46 defines a base on which the vertical columns 66 may be mounted through footings 86. As shown in FIG. 7, each footing may have a flat base plate 90 to be mounted flush with the horizontal floor 91 of the basin, and a vertical casing 92 in which the bottom end 94 of the vertical column 66 is held. In cross-section, the vertical casing is shaped to mate with the column so that there is a relatively tight fit between the casing and the column. The flat base 90 of each footing may be bolted to the floor 91 of the basin to maintain the position of the cooling tower on the basin.

Figure 9:
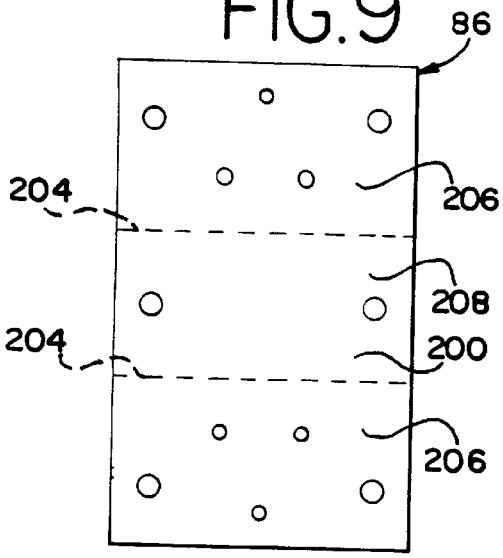
FIG. 9 is a top plan view of the sheet used for the footing bracket of FIG. 8 laid flat and prior to its being bent into the shape shown in FIG. 8.
Figure 11:
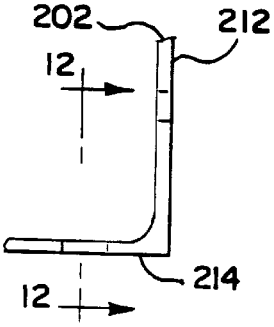
FIG. 11 is a side elevation of a bracket that may be used with the footing bracket of FIG. 8 or with other angles as a footing for the present invention.
Figure 12:
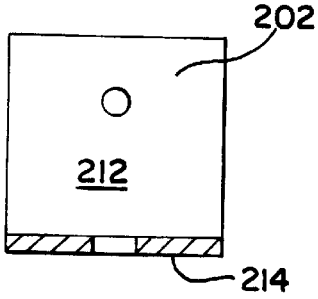
FIG. 12 is a cross-section taken along line 12—12 of FIG. 11.

An alternate footing is shown in FIGS. 8–12. As there shown, an U-shaped bracket 200 may be used in conjunction with a pair of angles 202 as a footing 86. The U-shaped bracket 200 may be formed from a flat metal sheet, as shown in FIG. 9, bent along fold lines 204 so that the end sections 206 are perpendicular to the center section 208. The width of the center section 208 between the fold lines 204 is great enough to tightly hold the bottom end 94 of the column 66 between the upstanding sides defined by the end sections 206. The bracket 200 may be attached to the bottom end of the column through one or more bolts 210 extending through the column and both sides 206 of the bracket.

Figure 10:
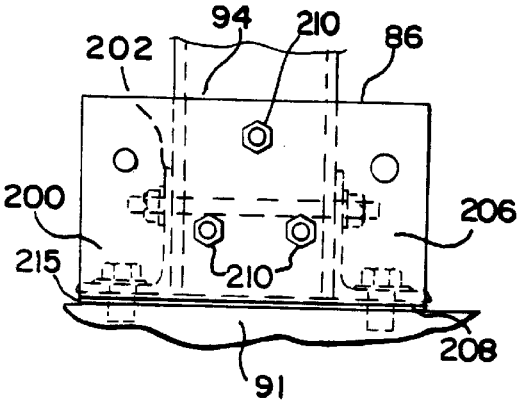
FIG. 10 is a side elevation of the bottom of a column with the footing bracket of FIG. 9 with two angles mounted on the bottom end of a column.

To secure the bracketed column end to the floor, the pair of angles 202 may be bolted to the column end as shown in FIG. 10 and then the entire assembly can be bolted to the floor of the basin with bolts extending through the angles and the underlying center section 208 of the bracket 200. Alternatively, a group of angles 202 could be used to connect each column to the floor of the basin, with the vertical surfaces 212 of the angles bonded to the column end as described below.

Alternatively, it may be desirable to provide an upstanding member that is received within the column rather than encasing it. In any of these embodiments, two perpendicular flat surfaces, such as the flat base 90 and vertical casing 92, the center section 208 and sides 206 of the bracket, and the two faces 212, 214 of the angle members, are provided for securing the footing to the column 66 and to the base 46; bolts, for example, may be used to secure the footings to the concrete floor of the basin.

Figure 7A:
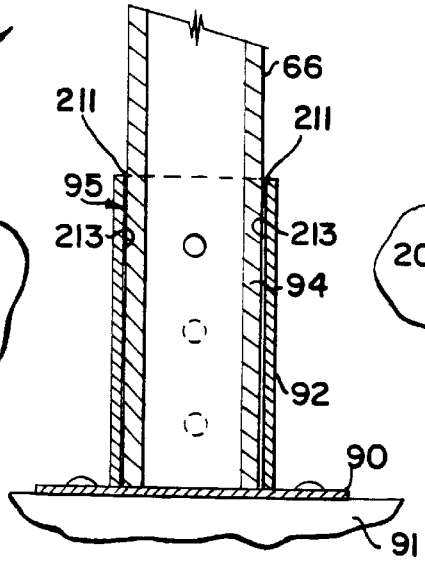
FIG. 7A is a cross-section taken along line 7A—7A of FIG. 7.
Figure 8:
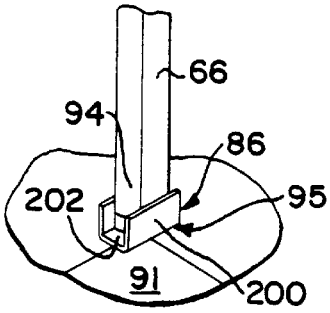
FIG. 8 is an enlarged partial perspective view of another embodiment of a footing that may be used with the present invention.

In some instances it may be desirable to bond the bottom end 94 of the column 66 to the vertical casing of the footing 86, or to the vertical end sections 206 of the U-shaped bracket 200 and angles 202. In some other instances it may also or alternatively be desirable to bond the flat base plate 90 footing 86 to the base or floor 91 or the basin. Thus, as shown in FIG. 7A, there may be a layer of bonding material or adhesive 211 between the inside walls 213 of the vertical casing 92 of the footing; bonding material or adhesive may also be present between the vertical end sections 206 of the U-shaped bracket and the faces of the bottom end 94 of the column 66, or between the vertical faces 212 of the angle members 202 and the faces of the bottom end of the column. As shown in FIG. 10, there may be a layer of adhesive or bonding material 215 between the center section 208 of the bracket 200 and the floor 91; there may alternatively be a layer of bonding material between the bottom surfaces 214 of the angles 202 and the floor 91; there may be bonding material or adhesive between the flat base 90 and the floor 91. However, in many installations the columns may be attached to the footings and the footings to the floor without the use of adhesive or bonding material.

The present invention provides a unique joint between each column 66 and beam 68. While traditional bolted joints have allowed for relative rotational movement between such columns and beams, the present invention provides substantially rigid joints, with no relative motion at design loads. While in traditional joints there is no transfer of moments between the beams and the columns, in the present invention there is such a transfer. The joints 59 may be characterized as being moment-transferring, meaning that there is substantially no relative motion between the joined members at design dead weights and lateral loads. The connections between the bottom ends 94 of the columns 66 and the base 46 may be similarly moment-transferring. Accordingly, in the present invention, the design limitation for lateral forces is the stiffness of the vertical columns. The tower can be constructed to withstand anticipated shear loads without using cross-bracing or shear walls, or with reduced use of such elements.

To provide such a moment-transferring joint 59 between the columns and beams, the present invention uses a combination of a rigid mounting member and bonding material. At each juncture or intersection 61, a mounting face or surface 101 of a mounting member 100 is placed to cover and bond to a part of the meeting co-planar surfaces 67, 69 of the vertical column 66 and horizontal beam 68. In the illustrated embodiment, the mounting members comprise plates that cover the entire widths of the flat co-planar faces 67, 69 of each of the meeting members 66, 68, and extend laterally to cover the entire width of a part of the flat face of each of the adjoining meeting members. Between the column and beam faces 67, 69 and the juxtaposed inner mounting face 101 of the mounting member is a thin layer of adhesive or bonding material 102. The adhesive 102 serves to bond the plate to the column and beam to create a moment-transferring connection or joint 59, with substantially no relative movement between the plate and the members to which it is adhered, and hence substantially no relative movement between the joined column and beam. Without relative movement, moments can be transferred from the beams to the columns.

With the structure of the present invention, the upper levels 42 of the cooling tower may be substantially free from diagonal bracing against lateral and shear loads. This freedom from diagonal bracing is particularly advantageous in the interior volume 65 of the structure, because the fill levels are then free from interference by the braces, as is the water distribution level, making it easier and faster to install both the fill and water distribution system. This improved accessibility should also be beneficial in replacing, cleaning or repairing parts such as the nozzles in the water distribution system. Deceasing the number of diagonal braces is advantageous in reducing the material costs for the tower, reducing construction time and costs. The number and variety of parts needed at the construction site are also significantly reduced, allowing for even greater construction efficiency. Moreover, it may be possible to produce modular frame units for even faster assembling on-site.

Sample mounting plates useful in the present invention are illustrated in FIGS. 13–20B. As there shown, there need only be a few basic shapes of mounting plate that need be provided to meet the needs of field erection of cooling towers. A first basic shape is that shown in FIGS. 14 and 17 for a typical connection at a corner between a vertical column and a horizontal beam meeting the column. As shown, this mounting plate 100 has an elongate area 103 for mounting to the vertical column 66 and an integral beam mounting area 104 of a shorter length. Both areas 103, 104 have widths of at least about five inches, for use with a vertical column having a width of about five inches. Generally, it is preferred that the beam mounting area 104 have a length to at least cover the width of the beam. In the illustrated embodiment, there may be beams with widths of, for example, five, seven or ten inches, so a universal mounting plate may be made to cover a ten-inch beam. In this way, one size mounting plate can be provided in a kit and used for any size beam likely to be used in the cooling tower frame.

Figure 13:
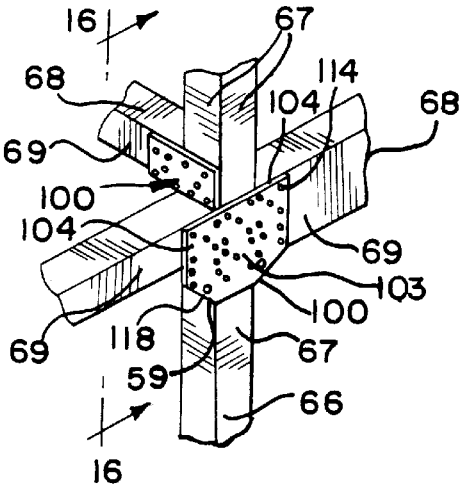
FIG. 13 is an enlarged partial perspective view of a moment-transferring joint between a column and three beams, with one beam larger than the others.
Figure 14:
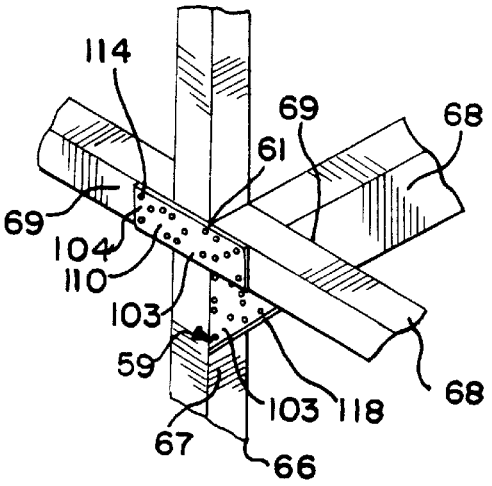
FIG. 14 is an enlarged partial perspective view of another moment-transferring joint between a column and three beams, with one beam larger than the others.
Figure 18:
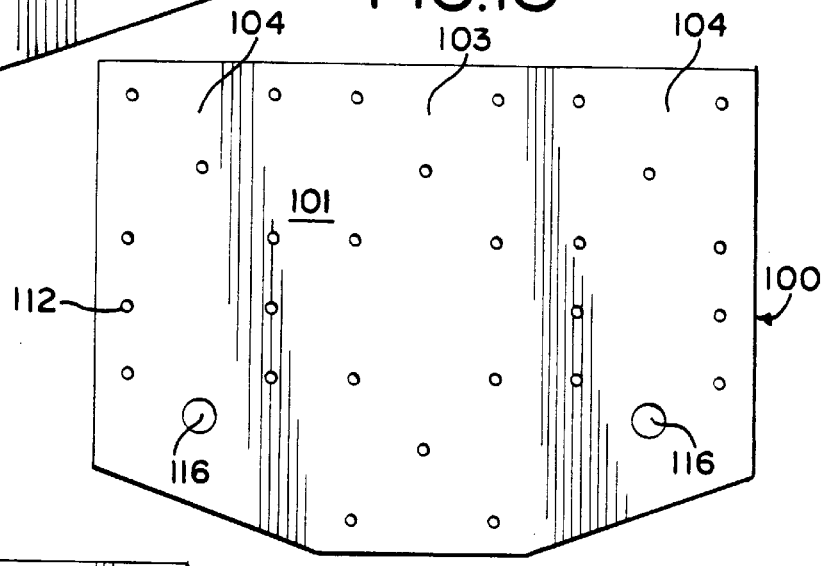
FIG. 18 is a plan view of another embodiment of a mounting plate of the present invention.

Another basic shape is shown in FIGS. 13 and 18. That shape is for use at 10 intersections where more than one horizontal beam 68 is joined to one vertical column 66. The shape is similar to the first shape, but two co-planar beam mounting areas 104 are provided on both sides of the co-planar elongate area 103 for attachment to the vertical column.

Figure 15:
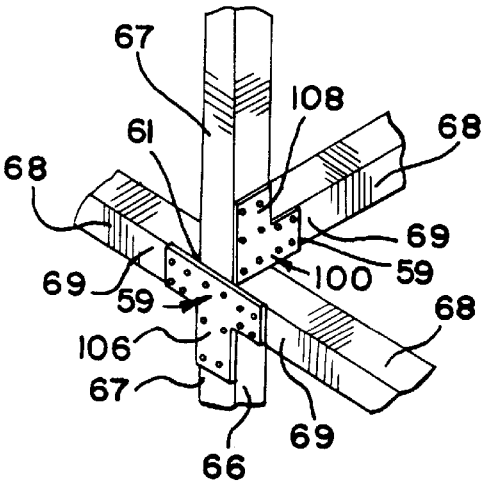
FIG. 15 is an enlarged partial perspective view of another moment-transferring joint between a column and three beams of the same size.

Alternate mounting plate shapes are shown in FIGS. 15–16 and 19–20. As there shown, the mounting plates can comprise T-shapes 106, as shown in FIG. 15, L-shapes 108, as shown in FIG. 15, and rectangular shapes 110, as shown in FIG. 13–14 and 19–20. As shown in FIGS. 13–16 and 21, the skeletal frame structure may include all or some of these various shapes of mounting plates, depending on the size of beam used.

Figure 16:
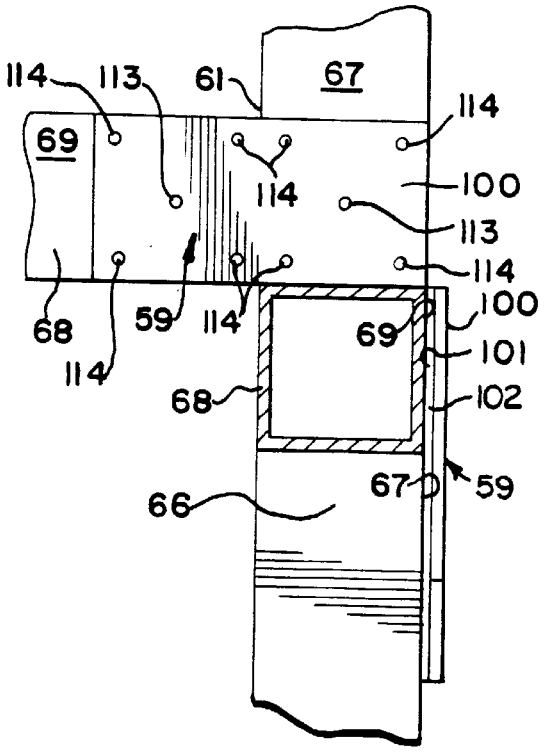
FIG. 16 is a cross-section taken along line 16—16 of FIG. 13.
Figure 20:
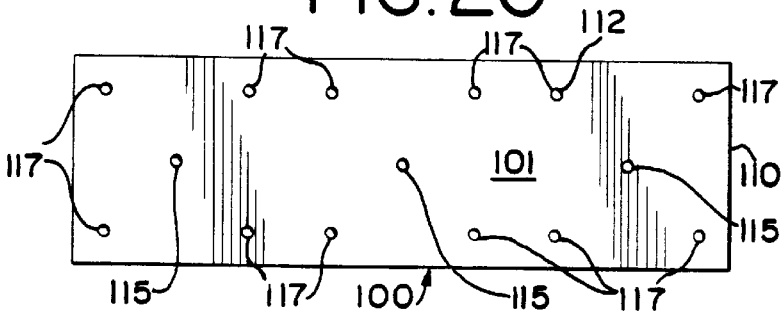
FIG. 20 is a plan view of another embodiment of a mounting plate of the present invention.

The mounting plates 100 preferably have pre-drilled holes 112 through which self-tapping screws 113 and tech screws 114 may be screwed into the columns 66 and beams 68. As will be understood by those in the art, tech screws are generally self-drilling and self-tapping. The self-tapping screws 113 and tech screws 114 are placed before the adhesive sets, during construction, and serve to hold the cooling tower frame structure together during construction. Generally, in the illustrated embodiment, the self-tapping screws 113 are inserted through holes in the mounting plates 100 and through holes in the faces 67, 69 of the columns and beams 66, 68; the tech screws 114 are inserted through holes in the mounting plates 100 and into the faces 67, 69 of the columns and beams 66, 68, forming their own openings into the columns and beams. These connections bear the dead load of the structure during construction and define construction joints. These construction joints also bear any live loads such as wind and seismic loads during construction. These connections also serve to hold the inner mounting face 101 of the mounting plate and faces 67, 69 of the adjoining columns and beams in intimate contact with the adhesive so that bonding occurs between these elements. As shown in FIGS. 16 and 20, the self-tapping screws 113 may, for example, be used at the interior holes 115 of the mounting plate and the tech screws 114 at the outer holes 117 around the perimeter of the mounting plate. Additionally or alternatively it may be desirable to provide holes 116 for one-quarter inch through bolts 118 to extend through the plate and into the beam and column to locate and space the beam and column during construction. It should be understood that other sizes of through bolts may be used, such as five-eighths inch through bolts. The bolts may also be positioned outside the column and beam surfaces, to hold any oversized portions of the mounting plates at a desired spacing and limit deformation of the mounting plates.

The mounting plates may be made of, for example, stainless steel or galvanized metal, or may be fiber reinforced plastic plates. Any material may be used that provides the needed strength and that will withstand the expected environment, particularly the wet environment in the interior of the cooling tower. In the illustrated embodiment, the mounting plates may be 12 gauge 304 or 316 stainless steel. In some applications, it may be desirable to use a mix, with some materials being used in the interior of the tower and others being used at the perimeter, for example.

Figure 20A:
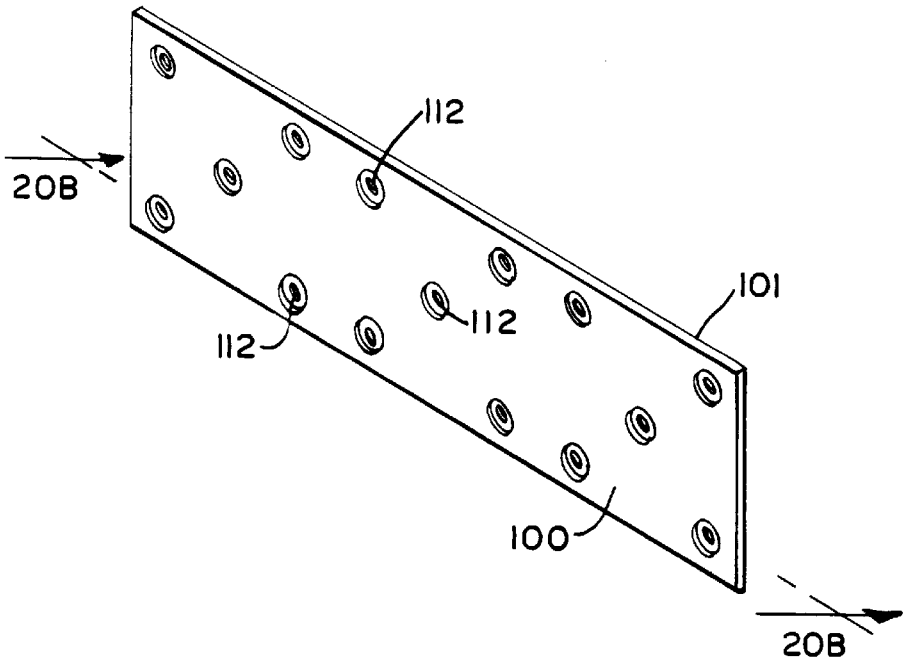
FIG. 20A is a perspective view of an embodiment of a mounting plate of the present invention, having a layout like the embodiment of FIG. 20 but with a dimpled surface.
Figure 20B:
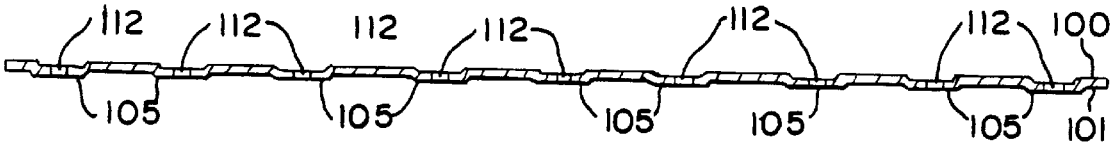
FIG. 20B is a cross-section taken along line 20B—20B of FIG. 20A.
Figure 21:
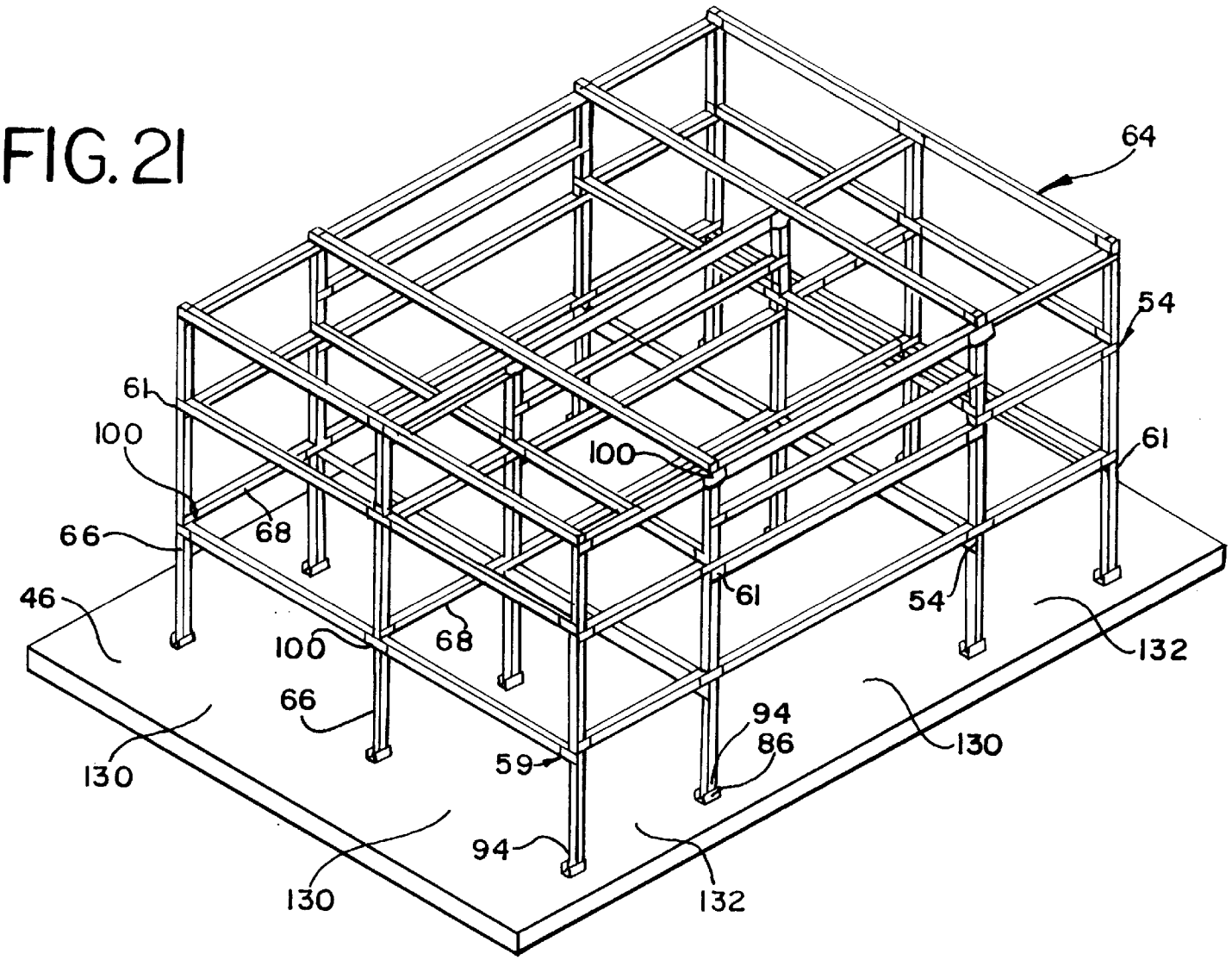
FIG. 21 is a perspective view of an alternate skeletal support structure according to the present invention.

In the illustrated embodiment, the adhesive or bonding material 102 is a thin layer placed between the inner mounting face 101 of each mounting plate 100 and the co-planar faces 67, 69 of each column 66 and beam 68 to which the mounting plate is secured. The adhesive strength may vary with the thickness of the bonding material. The adhesive may typically be on the order of 2–15 mils in thickness. To assist in ensuring that the proper amount of adhesive is present, the inner mounting face 101 of the mounting plate 100 may be dimpled as shown in the embodiments of FIGS. 20A and 20B, with annular raised areas 105 surrounding the pre-drilled holes 112 for the screws. The heights of the raised areas may be used to define the available thickness for the adhesive, since the raised areas 105 of the inner mounting face 101 may abut against the co-planar faces 67, 69 of the column 66 and beam 68, with bonding material extending between the remainder of the inner face 101 and the co-planar faces 67, 69. Such dimpling may be used with metal mounting plates 100.

Thus, in the illustrated embodiments, the mounting surface or face 101 of the mounting plates 100 may either be planar or may have raised areas 105. The mounting surface or face 101 is on one side of the mounting plate. The mounting surface or face may comprise substantially the entire inner surface of one side of the plate or may comprise an area or areas on the inner surface on one side of the plate.

Relief holes may also be provided in the mounting plates 100 so that excess adhesive may flow out. Such holes may also be advantageous in that the adhesive may extend from the surface of the columns and beams to the surface of the mounting plate and through the thickness of the mounting plate. Excess adhesive may extrude through the holes to indicate that sufficient adhesive was used and to give an additional positive bond area.

The adhesive or bonding agent 102 should be one that is waterproof when cured and that will bond to both the material used for the beams and columns and the material used for the mounting plates. The adhesive or bonding material may be, for example, an epoxy, such as "Magnobond 56 A&B" or "Magnobond 62 A&B" available from Magnolia Plastics of Chamblee, Ga.; Magnobond 56 is a high strength epoxy resin and modified polyamide curing agent adhesive designed for bonding fiber reinforced plastic panels to a wide variety of substrates. Alternatively, a methacrylate adhesive may be used. Suitable methacrylate adhesives are "PLEXUS AO420" automotive adhesive and "PLEXUS AO425" structural adhesive available from ITW Adhesive Systems of Danvers, Mass. It is expected that other construction adhesives will work in the present invention. For example, it may be desirable to use an adhesive that is provided in sheet form, such as an epoxy carried on both sides of a thin sheet or film; a 3M adhesive tape known as model VHB, available from 3M of St. Paul, Minn., or similar products such as automotive adhesives may be used; these and similar products are intended to be encompassed in the terms "adhesive", "bonding agent" and "bonding material". These adhesives or bonding materials are identified for purposes of illustration only; other adhesives or bonding materials may be used and are within the scope of the invention.

Generally, a generous application of adhesive or bonding material may be desirable to ensure that an adequate amount is present. Surface preparation may also improve the bond produced, so sanding of the co-planar surfaces 67, 69 at the intersections 61 of the columns 66 and beam 68 and mounting surfaces 101 of the mounting members may improve the bond. Degreasing the sanded parts with solvents such as acetone or alcohol before applying the bonding material may also improve the bond.

In selecting an adhesive or bonding material 102, it is desirable to select one that interacts favorably and is compatible with the constituents of the beams and columns, such as any release agent in the fiber reinforced material that may migrate to the surface, so that the bonded joint is not weakened by the interaction of the bonding material and beam and column constituents. Some materials used in some pultrusions can cause failure of the bond of the epoxy or methacrylate or other bonding material. Certain release agents do not affect the strength of the bond and should be used in the manufacturing process. One example of a release agent compatible with the above-identified adhesives is sold by Blendex, Inc., of Newark, N.J., as "TECH-LUBE 250-CP"; this product is identified as being a proprietary condensation product of resins, fatty glycerides and organic acid derivatives mixed in with modified fatty acids and phosphate esters.

It is also desirable to use an adhesive that can be applied, and that will set up and cure in a wet environment, and that will not lose its strength in a wet environment. The cured joint should not be so flexible as to allow for relative movement between the columns and beams at anticipated loads: the bond strength should be great enough to maintain the rigidity of the joints through anticipated loading of the structure; although the joints may not be rigid through all loading that they will experience in use, they should maintain their rigidity through a selected range of lateral forces.

When the adhesive 102 sets up and cures, it forms a rigid joint that not only bears the dead load of the structure, but also braces the frame and cooling tower against lateral forces, transferring moments from the horizontal beams to the vertical columns. In this way, the vertical columns' rigidity and resistance to bending from the vertical may be the limiting design criteria for anticipated wind and earthquake loads.

One result of using the rigid joints of the present invention is that the cooling tower frame needs fewer or no diagonal braces, particularly in the upper levels 42. Although it may be desirable to include some diagonal bracing at the bottom air intake level 44, as shown in FIGS. 5–6, it is generally unnecessary to do so in the upper levels since the moment-transferring joints 59 transfer shear loads from lateral forces to the vertical columns. As indicated, decreasing the number of diagonal braces is advantageous in reducing material and labor costs for the tower, increasing construction efficiency and improved accessibility. While outer cladding of the tower may be secured to the beams or columns 66, 68, the cladding would generally not be designed to comprise a load-bearing brace for live loads such as from wind and seismic activity.

Figure 23:
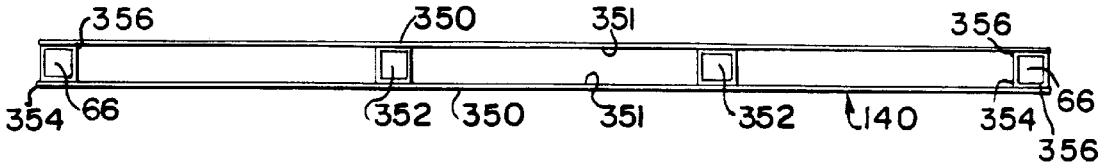
FIG. 23 is a cross-section taken along line 23—23 of FIG. 22.
Figure 22:
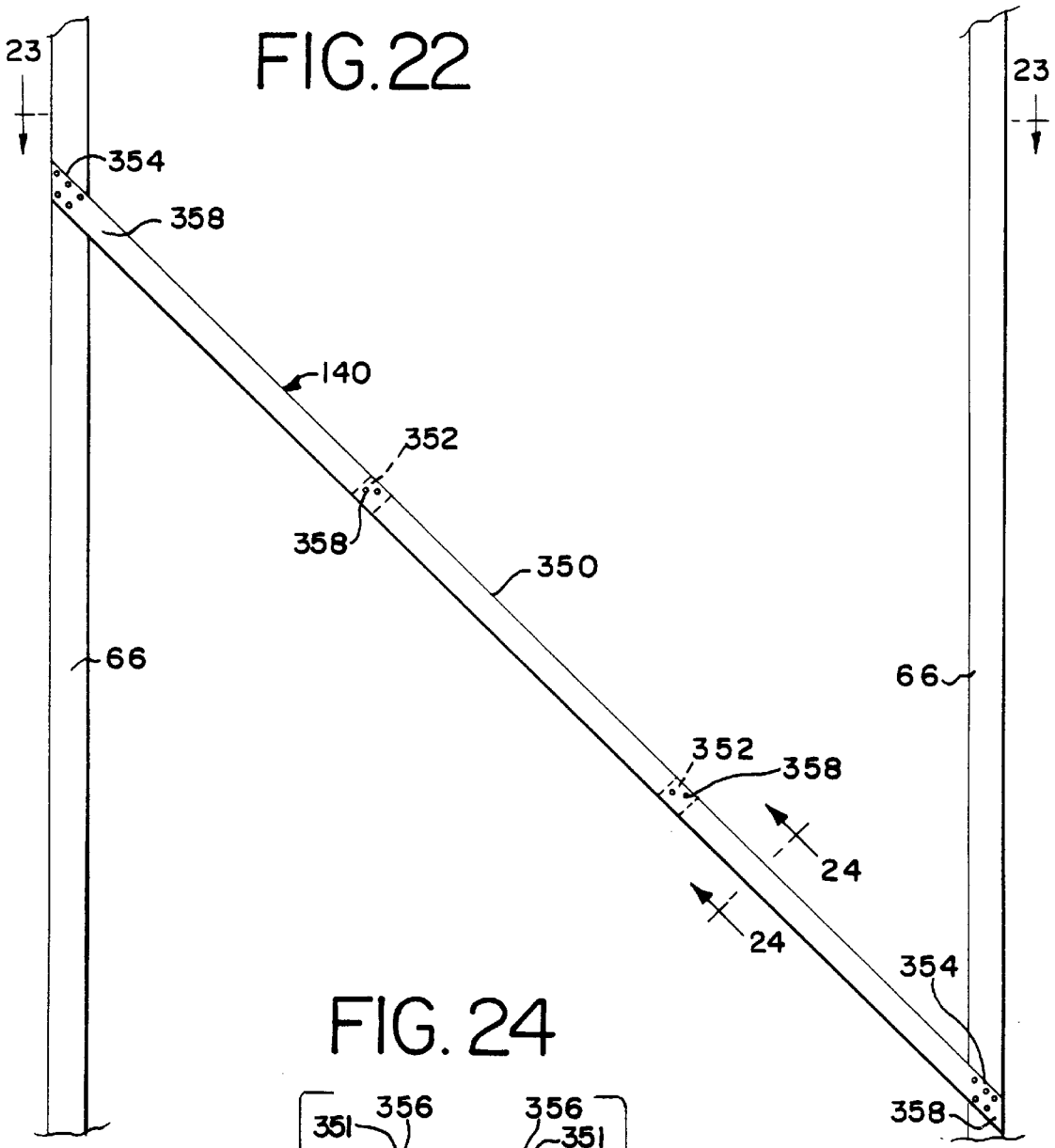
FIG. 22 is a partial side elevation of a pair of columns braced with a diagonal C-channel brace member.
Figure 24:
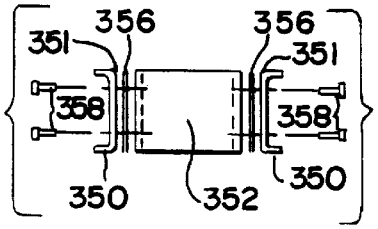
FIG. 24 is a cross-section taken along line 24—24 of FIG. 22.

As shown in FIGS. 5–6, diagonal braces 140 may be included on the air intake level 44. It may be desirable to use a plurality of C-channel braces 350 as shown in the embodiment of FIGS. 22–24. The braces 350 may have flat faces 351, tubular spacers 352, and may define moment transferring connections 354 with the columns, with bonding material 356 and tech screws 358 as disclosed in U.S. patent application Ser. No. 08/711,261. Alternatively, metal rod braces may be used for smaller towers.

The cooling tower of the present invention may be field erected, with the adhesive or bonding material applied and allowed to cure on site, or it may comprise a unit that is partially or totally manufactured and assembled off site.

Figure 25:
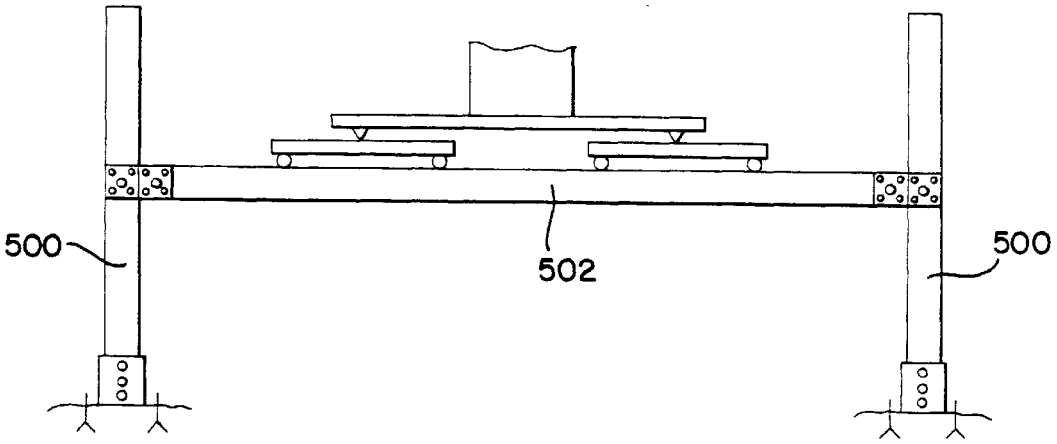
FIG. 25 is a side elevation of a test set-up for testing the deflection of a beam under different loads.

Tests were run on the apparatus illustrated in FIG. 25. A load-applying apparatus and deflection meter were used, applying a load at four points along the length of a beam 502 held between two columns 500. The four points of load application were about equally spaced along the span of the beam. The load was gradually increased until failure of either the beam or the joint. Deflection was measured at about the center of the beam, with an electronic readout. For all the test results, the data is presented in the following tables, indicating the total load applied in pounds under the headings "Load"; measured deflections at the centers of the beams is reported in inches under the heading "Deflection"; and the ratio of the length of the beam to the deflection has been calculated for each measured deflection and are reported in the tables under the headings "L/D".

For each of the tests, the same span of 137.75 inches for the beams was used. Actual construction conditions were simulated in that a slight spacing was left between the beam ends and the columns, as would be done in construction to ease placement of the beams between the columns. The columns were each 69 inches high, and the top of the beams were placed about twenty-four inches from the top free ends of the columns. The overall distance between the outer surfaces of the columns was about 148 inches.

Figure 27:
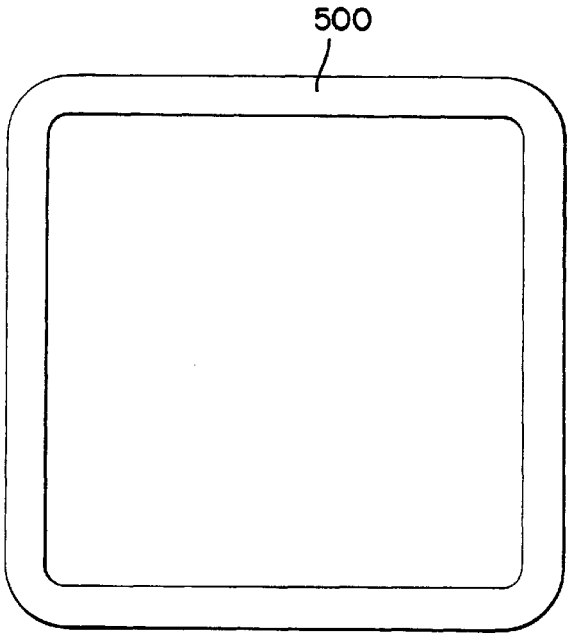
FIG. 27 is an end view of a column of the type that was tested using the set-up of FIG. 25.

For each test, the column elements 500 were supplied by Creative Pultrusions, Inc. of Alum Bank, Pa. The column elements 500 had end views as illustrated in FIG. 27, with overall dimensions of about 5.2 inches by 5.2 inches, with wall thicknesses of about 0.375 inches. The columns were pultruded fiber reinforced plastic, made from thermoset polyester resin, FR-Class 1 and glass fibers.

For the tests with beams designated as "5×5", the beam elements 502 for the tests were of the same material as the columns 500. For the tests referring to "5×10" beams, the beams were the type illustrated in FIG. 26, with a top wall 504 and bottom wall 506 thickness of about 0.425 inches, a sidewall 508 thickness of about 0.300 inches between the top and bottom walls, and the flanges 510 having thicknesses of about 0.375 inches. For the tests of beams designated as "5×7", the beams have been as described for the 5×10 beams with the flanges 510 removed.

For both the 5×7 and 5×10 beams, the beams were made by pultrusion, using a heated die through which glass fiber material was pulled while thermoset resin was injected into the heated die. The resin was a high grade fire retardant poly ester, with ultraviolet protection additives. The lay up of the glass fiber materials included an outer veil, with a minimum thickness of 12 mil., to provide additional ultraviolet protection. The lay up also included layers of woven glass fiber mat, minimum 35 mil. thick, to provide protection from corrosive materials, process liquids, and water. The lay up also included additional layers of glass fiber veil material, continuous strand mat, woven mat, and combinations of continuous fiber roving arranged unidirectionally, including strands of spun roving and straight roving. The glass was Type C or Type E glass. The products were sealed with polyester resin sealer or base resin to prevent moisture migration.

Although these specific materials were used in the following examples, it is expected that other materials may be selected for the beams and columns, and that those other materials will perform similarly. For example, a vinyl ester resin could be used, and other fibers may be used.

EXAMPLE 1

A test frame comprising two 5×5 columns of the type described above and a 5×10 beam of the type described above was constructed with four mounting members. The mounting members were made of 12 gauge 300 series stainless steel and were connected to the beam and columns with both bonding material and mechanical fasteners. The bonding material used was Magnobond 56 A and B epoxy. The mounting member had the shape illustrated in FIG. 17. The beam and column surfaces were sanded and wiped with acetone wipes prior to applying the epoxy. The mounting plates were also sanded and wiped with acetone wipes prior to being applied to the beam and columns. The mechanical fasteners were tech screws extending through the mounting member and the beam or the column. The only bolts were at the holes 116 (FIGS. 17–18) beyond the extent of the beams and columns, to support the plates against bending or other deformation. After the epoxy adhesive had fully set, the test frame was mounted to the floor of the test assembly using brackets as illustrated in FIG. 25. A continuously increasing load was applied using an apparatus like that shown in FIG. 25. The deflection of the beam at the center of the beam was measured at different loads, as set forth in the table below.

The results were compared to models of simple and rigid or moment-transferring connections as set forth in the columns labeled "Model Deflection" and "Simple" and "Moment". The models for deflection of simple and moment joints or connections at each of the test levels of load were calculated using computer software, the "RISA-3D" Rapid Interactive Structural Analysis 3 Dimensional Version 1.01 from RISA Technologies of Lake Forest, Calif. For use in these calculations, the moment of inertia was first determined to be 96.9 in.$^4$ and a flexural or Young's modulus was assumed to be 5,900,000 lbs./in.$^2$ based upon deflection tests of similar beams with simple supports. The shear modulus for this beam was 425000 lbs./in.$^2$ and the shear area was 9.85 in.$^2$. The end conditions assumed for the simple support model were simple support connections. This computer software performs a three-dimensional finite element analysis to calculate the model deflections for the simple and moment-transferring connections. All of the model deflections in the following tables were calculated using the "RISA-3D" software, using the flexural moduli, moments of inertia and other factors as reported for each size of beam. Other computer software and standard methods, formulas or matrices for calculating model deflections for simple and moment-transferring connections may be used, to draw comparisons between the tested joints and the models.

The test was repeated three times, and the results are reported in the following table for each of these tests. The length to deflection ratios were also calculated for each data point and are reported in the column headed "L/D", and compared to a length to deflection ratio (L/D) of 180, equating to a maximum deflection of 0.7644 in. for this length of beam (137.75 in.). It should be understood that the L/D of 180 is used for purposes of illustration only, and that other L/D ratios may be used and are within the scope of the invention.

From these tests, it can be seen that at loads corresponding with a beam length to deflection ratio of 180, the joints supported beams bearing loads of about 12,000 lbs. Moreover, in each of these tests, the beam failed before the joint. And, at loads corresponding to beam length to deflection ratios of 180 and higher, or deflections of 0.7644 in. and less at lengths of 137.75 in., the beam deflections more closely followed the model of a beam with moment-transferring joints or supports than the model of a beam with simple joints or supports. Thus, the joints were substantially moment-transferring or rigid joints at loads yielding a beam length to deflection ratio of 180 and higher. As indicated, other length to deflection ratios may be used, and the beams with the illustrated joints also more closely followed the model of a beam with rigid supports than a beam with simple supports at loads yielding length to deflection ratios less than 180.

| | Test PT3-10/EPX | | *Test PT2-10/EPX | | **Test PT1-10/EPX | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | 0 | — | 0 | — | 0 | — | 0 | 0 |
| 700 | 0.04 | 3444 | 0.038 | 3625 | 0.063 | 2187 | 0.063 | 0.042 |
| 2700 | 0.141 | 977 | 0.151 | 912 | 0.171 | 806 | 0.245 | 0.161 |
| 3700 | 0.197 | 699 | 0.204 | 675 | 0.228 | 604 | 0.335 | 0.221 |

| | Test PT3-10/EPX* | | *Test PT2-10/EPX | | **Test PT1-10/EPX | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 4700 | 0.253 | 544 | 0.26 | 530 | 0.286 | 482 | 0.426 | 0.281 |
| 5700 | 0.308 | 447 | 0.316 | 436 | 0.347 | 397 | 0.517 | 0.34 |
| 6700 | 0.365 | 377 | 0.374 | 368 | 0.406 | 339 | 0.607 | 0.4 |
| 7700 | 0.424 | 325 | 0.434 | 317 | 0.47 | 293 | 0.698 | 0.46 |
| 8700 | 0.48 | 287 | 0.495 | 278 | 0.526 | 262 | 0.789 | 0.519 |
| 9700 | 0.539 | 256 | 0.56 | 246 | 0.59 | 233 | 0.879 | 0.579 |
| 10700 | 0.603 | 228 | 0.622 | 221 | 0.654 | 211 | 0.97 | 0.639 |
| 11700 | 0.664 | 207 | 0.686 | 201 | 0.719 | 192 | 1.061 | 0.698 |

-continued

| | | | | | | | | | |
|---|---|---|---|---|---|---|---|---|---|
| 12700 | 0.728 | 189 | 0.753 | 183 | 0.791 | 174 | 1.151 | 0.758 | |
| 13700 | 0.798 | 173 | 0.838 | 164 | 0.856 | 161 | 1.242 | 0.818 | |
| 14700 | 0.873 | 158 | 0.912 | 151 | 0.961 | 143 | 1.333 | 0.877 | |
| 15700 | 0.943 | 146 | 0.979 | 141 | 1.019 | 135 | 1.423 | 0.937 | |
| 16700 | 1.017 | 135 | 1.042 | 132 | 1.104 | 125 | 1.514 | 0.997 | |
| 17700 | 1.092 | 126 | 1.107 | 124 | 1.168 | 118 | 1.604 | 1.056 | |
| 18700 | 1.324 | 104 | 1.152 | 120 | 1.248 | 110 | 1.695 | 1.116 | |
| 19700 | 1.216 | 113 | 1.237 | 111 | 1.325 | 104 | 1.786 | 1.176 | |
| 20700 | 1.247 | 110 | 1.299 | 106 | 1.4 | 98 | 1.876 | 1.236 | |
| 21700 | 1.344 | 102 | 1.366 | 101 | 1.491 | 92 | 1.967 | 1.295 | |
| 22700 | 1.407 | 98 | 1.429 | 96 | 1.568 | 88 | 2.058 | 1.355 | |
| 23700 | 1.65 | 83 | 1.495 | 92 | 1.647 | 84 | 2.148 | 1.415 | |
| 24700 | 1.727 | 80 | 1.562 | 88 | 1.723 | 80 | 2.239 | 1.474 | |
| 25700 | 1.794 | 77 | 1.632 | 84 | 1.807 | 76 | 2.33 | 1.534 | |
| 26700 | 1.88 | 73 | 1.711 | 81 | 1.895 | 73 | 2.42 | 1.594 | |
| 27700 | 2.072 | 66 | 1.778 | 77 | 2.022 | 68 | 2.511 | 1.653 | |
| 28700 | 2.117 | 65 | 1.866 | 74 | 2.16 | 64 | 2.602 | 1.713 | |
| 29700 | 2.163 | 64 | 1.944 | 71 | — | — | 2.692 | 1.773 | |
| 30700 | 2.251 | 61 | 2.019 | 68 | — | — | 2.783 | 1.832 | |
| 31700 | 2.507 | 55 | 2.104 | 65 | — | — | 2.874 | 1.892 | |

**Beam Failure at about 28,000 lbs.
*Beam Failure at about 31,000 lbs.

EXAMPLE 2

Figure 17:
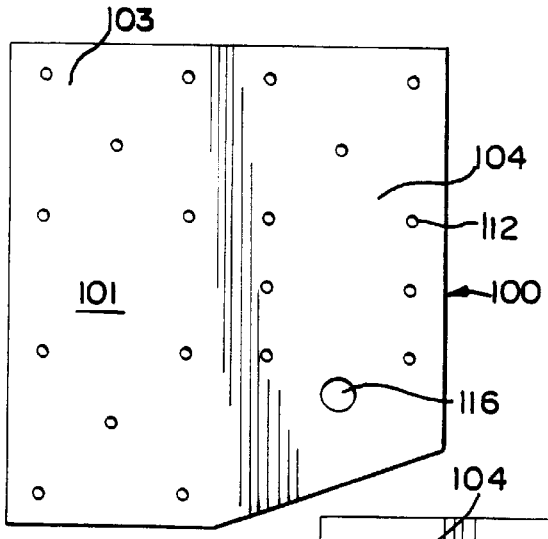
FIG. 17 is a plan view of an embodiment of a mounting plate of the present invention.
Figure 28:
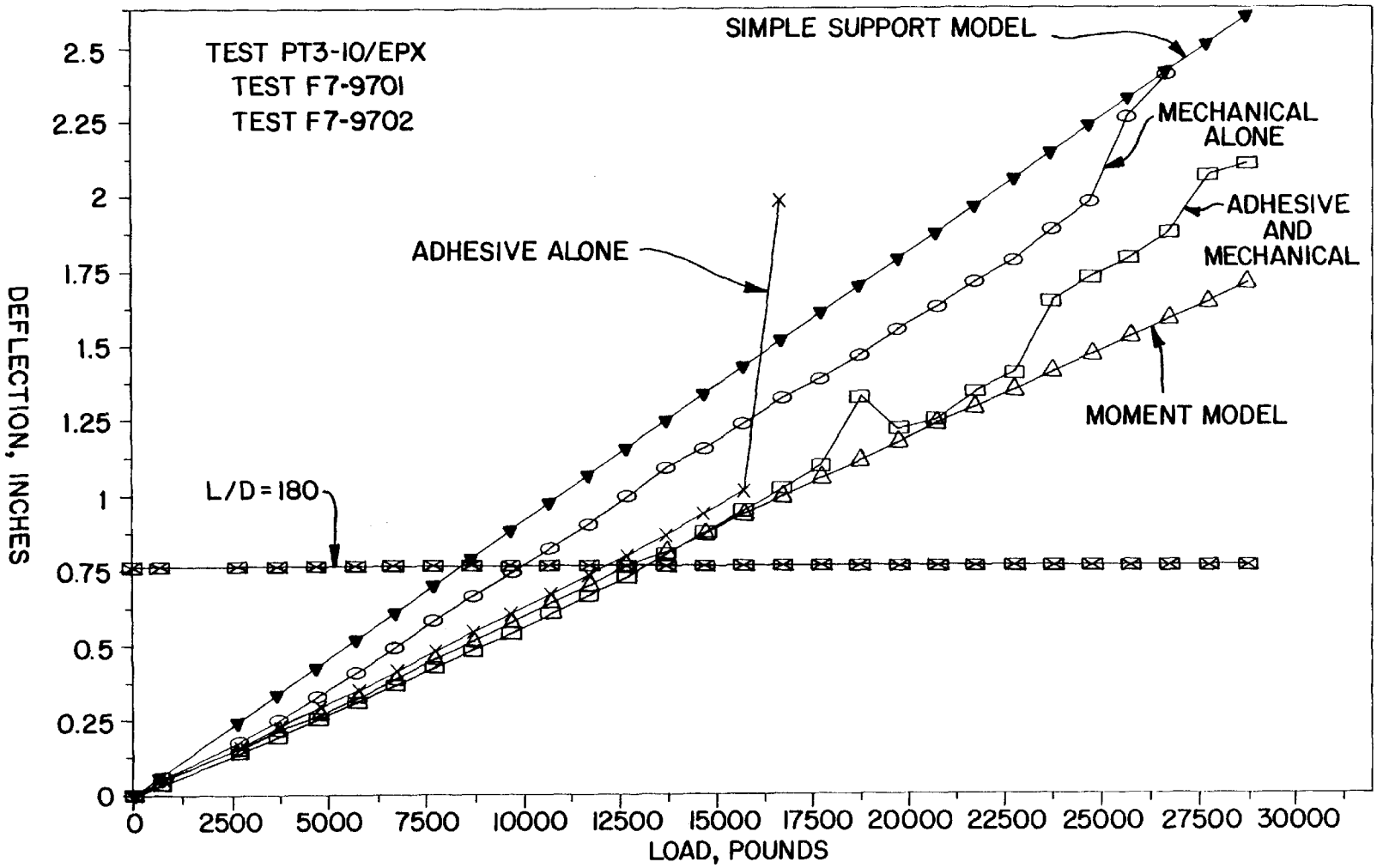
FIG. 28 is a graph of test results from the test set-up of FIG. 25 and calculated models for a 5×10 beam and 5×5 columns with stainless steel mounting plates.

Two additional samples were prepared using two 5×5 columns, a 5×10 beam, and four mounting plates of the type shown in FIG. 17 for each sample. In the first sample, no adhesive was used; instead tech screws alone were used. The results for the first sample are reported under the column headed "Mechanical Alone", with measured deflections reported under the column "Deflection" and calculated length to deflection ratios reported under the column "L/D." The second sample was prepared the same as the samples of Example 1, but the mechanical fasteners were removed after the epoxy adhesive had set and prior to testing the joint on the test apparatus. The results for the second sample are reported under the column headed "Adhesive Alone", with measured deflections reported under "Deflections" and calculated length to deflection ratios reported under the column "L/D". In the following table, these samples are compared to the results of the combined adhesive and mechanical joint (Test PT3-10/EPX) and to the model simple and model moment-transferring joints using the same calculated deflections and length to deflection ratios. These results and calculations are graphed in FIG. 28.

From the table and graph, it can be seen that the test beam with joints having combined adhesive and mechanical connectors more closely followed the model of a beam with rigid or moment-transferring joints than the model of a beam with simple joints or supports at least through the load that produced a beam length to deflection ratio (L/D) of 180 or greater, as does the beam with joints having bonding material without mechanical fasteners. Such joints should have substantially no relative movement between the beam and column through a load of at least the magnitude producing a beam length to deflection ratio of 180. Moreover, in constructing such a tower, before the bonding material cures, the mechanical connection should be able to support a beam bearing a load of up to at least 9700 pounds with less than 0.7644 inches in beam deflection. After the epoxy or other bonding material or adhesive has cured, the post-construction joints defined by the cured adhesive, mounting member, columns and beam can support the beam bearing loads beyond 11,700 lbs. without the beam deflecting more than 0.7644 inches. In addition, in both the "Mechanical Alone" sample and "Adhesive Alone" sample, the joint failed before the beam failed.

| | Adhesive & Mechanical PT3-10/EPX | | *Mechanical Alone | | **Adhesive Alone | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | 0 | — | 0 | — | 0 | — | 0 | 0 |
| 700 | 0.04 | 3444 | 0.055 | 2505 | 0.051 | 2701 | 0.063 | 0.042 |
| 2700 | 0.141 | 977 | 0.17 | 810 | 0.157 | 877 | 0.245 | 0.161 |
| 3700 | 0.197 | 699 | 0.245 | 562 | 0.23 | 599 | 0.335 | 0.221 |
| 4700 | 0.253 | 544 | 0.328 | 420 | 0.293 | 470 | 0.426 | 0.281 |
| 5700 | 0.308 | 447 | 0.407 | 338 | 0.355 | 388 | 0.517 | 0.34 |
| 6700 | 0.365 | 377 | 0.49 | 281 | 0.415 | 332 | 0.607 | 0.4 |
| 7700 | 0.424 | 325 | 0.579 | 238 | 0.48 | 287 | 0.698 | 0.46 |
| 8700 | 0.48 | 287 | 0.661 | 208 | 0.544 | 253 | 0.789 | 0.519 |
| 9700 | 0.539 | 256 | 0.742 | 186 | 0.604 | 228 | 0.879 | 0.579 |
| 10700 | 0.603 | 228 | 0.819 | 168 | 0.67 | 206 | 0.97 | 0.639 |
| 11700 | 0.664 | 207 | 0.899 | 153 | 0.725 | 190 | 1.061 | 0.698 |
| 12700 | 0.728 | 189 | 0.989 | 139 | 0.794 | 173 | 1.151 | 0.758 |
| 13700 | 0.798 | 173 | 1.086 | 127 | 0.862 | 160 | 1.242 | 0.818 |
| 14700 | 0.873 | 158 | 1.149 | 120 | 0.93 | 148 | 1.333 | 0.877 |
| 15700 | 0.943 | 146 | 1.23 | 112 | 1.005 | 137 | 1.423 | 0.937 |
| 16700 | 1.017 | 135 | 1.32 | 104 | 1.985 | 69 | 1.514 | 0.997 |
| 17700 | 1.092 | 126 | 1.385 | 99 | — | — | 1.604 | 1.056 |
| 18700 | 1.324 | 104 | 1.467 | 94 | — | — | 1.695 | 1.116 |
| 19700 | 1.216 | 113 | 1.553 | 89 | — | — | 1.786 | 1.176 |
| 20700 | 1.247 | 110 | 1.626 | 85 | — | — | 1.876 | 1.236 |
| 21700 | 1.344 | 102 | 1.713 | 80 | — | — | 1.967 | 1.295 |
| 22700 | 1.407 | 98 | 1.785 | 77 | — | — | 2.058 | 1.355 |
| 23700 | 1.65 | 83 | 1.891 | 73 | — | — | 2.148 | 1.415 |
| 24700 | 1.727 | 80 | 1.981 | 70 | — | — | 2.239 | 1.474 |
| 25700 | 1.794 | 77 | 2.267 | 61 | — | — | 2.33 | 1.534 |
| 26700 | 1.88 | 73 | 2.413 | 57 | — | — | 2.42 | 1.594 |
| 27700 | 2.072 | 66 | — | — | — | — | 2.511 | 1.653 |
| 28700 | 2.117 | 65 | — | — | — | — | 2.602 | 1.713 |
| 29700 | 2.163 | 64 | — | — | — | — | 2.692 | 1.773 |
| 30700 | 2.251 | 61 | — | — | — | — | 2.783 | 1.832 |
| 31700 | 2.507 | 55 | — | — | — | — | 2.874 | 2.892 |

*Joint failure above about 26,700 lbs.
**Joint failure above about 16,700 lbs.

EXAMPLE 3

Figure 26:
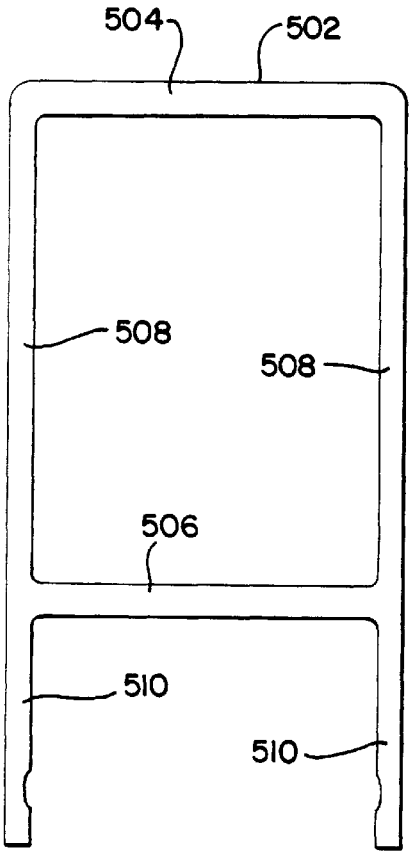
FIG. 26 is an end view of a beam of the type that was tested using the set-up of FIG. 25.
Figure 29:
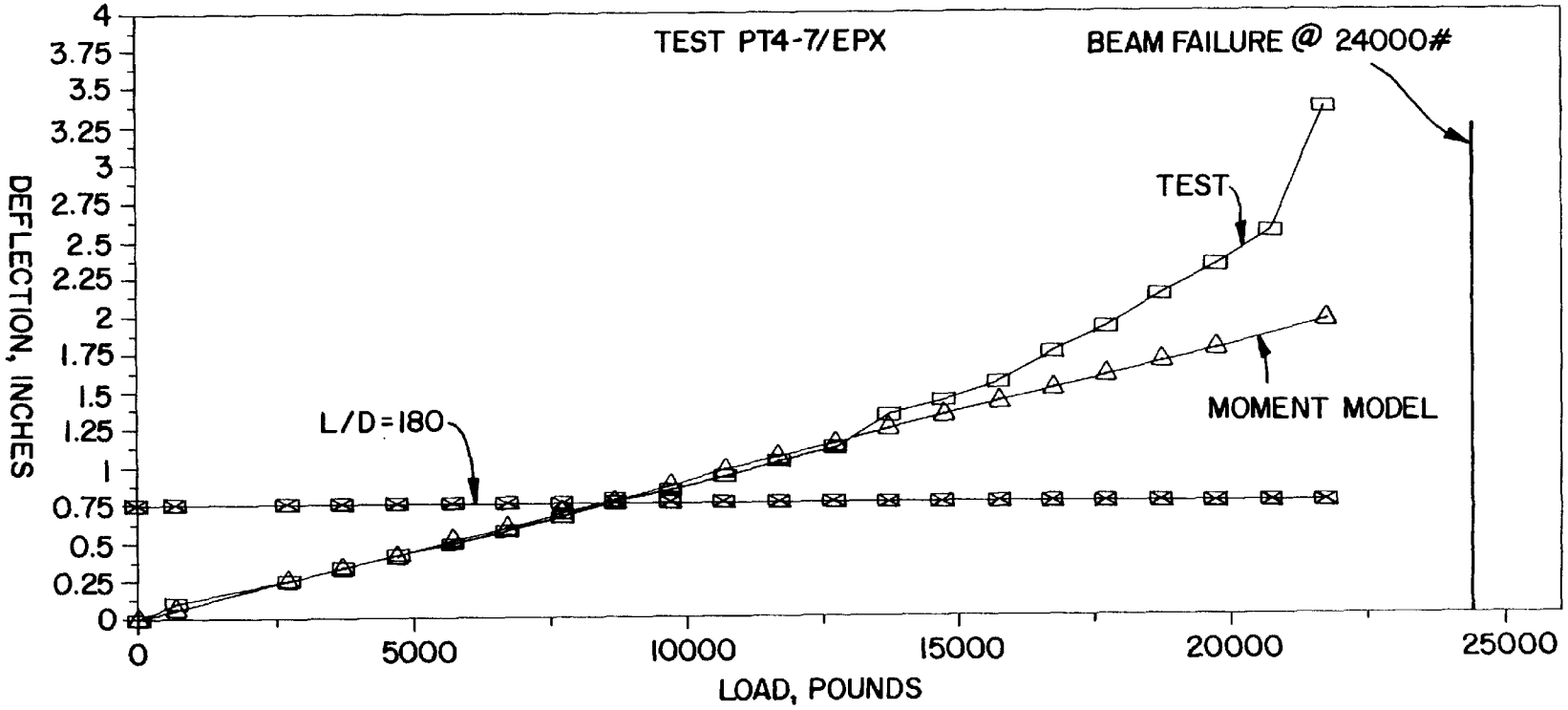
FIG. 29 is a graph of test results from the test set up of FIG. 25 and calculated moment transferring model for a 5×7 beam and 5×5 columns with stainless steel mounting plates.

The same procedure as set forth in Example 1 was followed, except the beams were 5×7 beams, made by removing the flanges 510 from the 5×10 beams illustrated in FIG. 26. For such beams the Youngs modulus was assumed to be 5,000,000 lbs./in.$^2$, based on deflection tests of the beam, and the moment of inertia was determined to be 58.41 in.$^4$. The shear modulus was 425,000 lbs./in.$^2$ and the shear area was 8 in$^2$. The test was repeated three times, and the results compared to calculated deflections for model simple joints and model moment-transferring or rigid joints. The beam length to deflection ratios were also calculated and compared to a beam length to deflection ratio (L/D) of 180, equating to a maximum deflection of 0.7644 in. for this length of beam (137.75 in.). From these tests, it can be seen that for a beam length to deflection ratio of 180, the joints supported a beam bearing a load of at least 8,700 lbs. Moreover, in each of these tests, the beam failed before the joint. And, for beam length to deflection ratios of 180 and higher, or beam deflections of 0.7644 inches and less, the beam more closely followed the model of a beam supported by a moment-transferring joint than the model of a beam supported by a simple joint. Thus, the joints were substantially moment-transferring or rigid joints at loads yielding a beam length to deflection ratio of 180 and higher. Moreover, the beams also more closely followed the model of a beam with rigid supports or joints than the model of a beam with simple supports or joints at loads yielding a beam length to deflection ration of less than 180. The results of Test PT4-7/EPX reported below are graphed in FIG. 29, compared to the moment transferring model and the deflection that would yield a length to deflection ratio of 180.

| | ***Test PT6-7/EPX | | **Test PT5-7/EPX | | *Test PT4-7/EPX | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | 0 | — | 0 | — | 0 | — | 0 | 0 |
| 700 | 0.1 | 1378 | 0.099 | 1391 | 0.109 | 1264 | 0.120 | 0.063 |
| 2700 | 0.238 | 579 | 0.23 | 599 | 0.254 | 542 | 0.465 | 0.244 |
| 3700 | 0.315 | 437 | 0.305 | 452 | 0.333 | 414 | 0.637 | 0.334 |
| 4700 | 0.393 | 351 | 0.393 | 351 | 0.413 | 334 | 0.809 | 0.424 |
| 5700 | 0.473 | 291 | 0.462 | 298 | 0.494 | 279 | 0.981 | 0.515 |
| 6700 | 0.556 | 248 | 0.563 | 245 | 0.577 | 239 | 1.153 | 0.605 |
| 7700 | 0.639 | 216 | 0.626 | 220 | 0.662 | 208 | 1.325 | 0.695 |
| 8700 | 0.724 | 190 | 0.71 | 194 | 0.756 | 182 | 1.497 | 0.786 |
| 9700 | 0.811 | 170 | 0.794 | 173 | 0.839 | 164 | 1.669 | 0.876 |
| 10700 | 0.901 | 153 | 0.883 | 156 | 0.93 | 148 | 1.841 | 0.966 |
| 11700 | 1.008 | 137 | 0.972 | 142 | 1.022 | 135 | 2.013 | 1.056 |
| 12700 | 1.088 | 127 | 1.069 | 129 | 1.118 | 123 | 2.185 | 1.147 |
| 13700 | 1.281 | 108 | 1.174 | 117 | 1.323 | 104 | 2.357 | 1.237 |
| 14700 | 1.547 | 89 | 1.277 | 108 | 1.43 | 96 | 2.529 | 1.327 |
| 15700 | 1.721 | 80 | 1.39 | 99 | 1.554 | 89 | 2.701 | 1.418 |
| 16700 | 1.857 | 74 | 1.588 | 87 | 1.75 | 79 | 2.873 | 1.508 |
| 17700 | 1.991 | 69 | 1.62 | 85 | 1.91 | 72 | 3.045 | 1.598 |
| 18700 | 2.176 | 63 | 1.724 | 80 | 2.13 | 65 | 3.217 | 1.688 |
| 19700 | 2.328 | 59 | 1.849 | 74 | 2.323 | 59 | 3.389 | 1.779 |
| 20700 | 2.487 | 55 | 2.344 | 59 | 2.55 | 54 | 3.562 | 1.869 |
| 21700 | 2.647 | 52 | 2.643 | 52 | 3.368 | 41 | | 1.959 |
| 22700 | 2.769 | 50 | 2.844 | 48 | — | — | | 2.05 |
| 23700 | 2.981 | 46 | 3.064 | 45 | — | — | | 2.14 |
| 24700 | 3.201 | 43 | — | — | — | — | | 2.23 |
| 25700 | 3.311 | 42 | — | — | — | — | | 2.32 |

*Beam failure at about 24,000 lbs.
**Beam failure at about 23,700 lbs.
***Beam failure at about 25,700 lbs.

EXAMPLE 4

Figure 19:
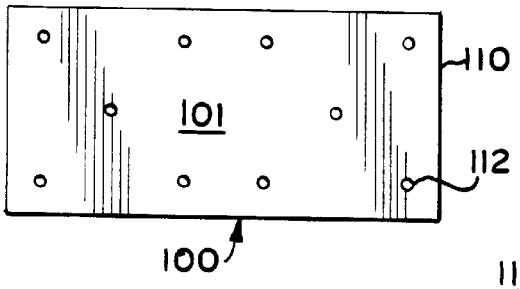
FIG. 19 is a plan view of another embodiment of a mounting plate of the present invention.
Figure 30:
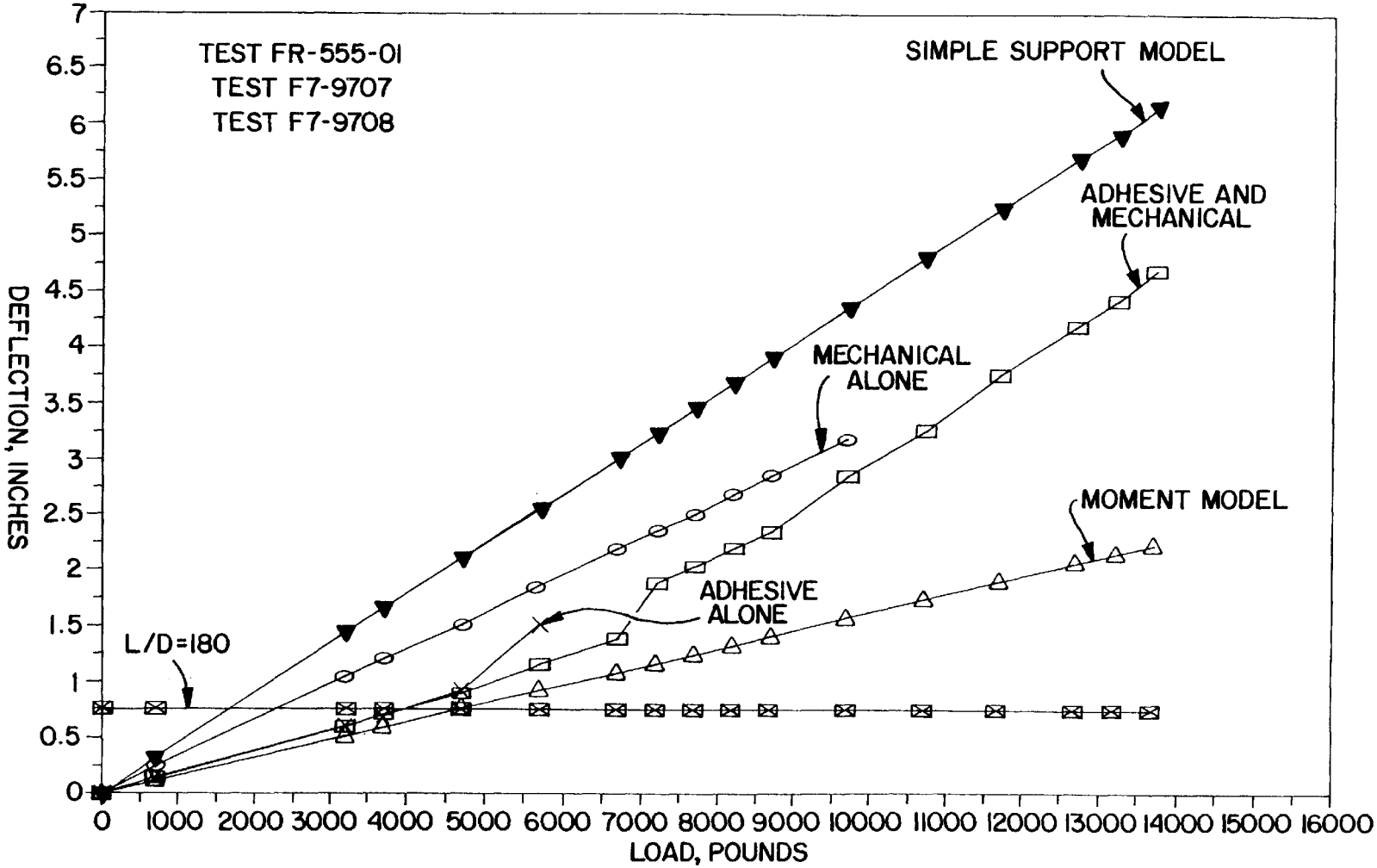
FIG. 30 is a graph of test results from the test set-up of FIG. 25 and calculated models for a 5×5 beam and 5×5 columns with stainless steel mounting plates.

The same procedure as set forth in Example 1 was followed, except the beams were 5×5 beams, the same material as the columns, and the mounting plates were of the type illustrated in FIG. 19, using 12 gauge stainless steel. The only mechanical fasteners used were tech screws in the tests labeled PT9-5/EPX, PT8-5/EPX, and PT7-5/EPX. In the test labeled FR-555-01, the mechanical fasteners also included through bolts, one extending through the mounting plate and the columns and through the opposite mounting plate and one extending through the mounting plate, beam and opposite mounting plate. The Youngs modulus was assumed to be 3,825,000 lbs./in.$^2$, based on deflection tests of the beam, and the moment of inertia was determined to be 28.25 in.$^4$. The shear modulus was 425,000 lbs./in.$^2$, and the shear area was 7.24 in.$^2$. The test was repeated three times, and the results compared to calculated deflections for model simple joints and model moment-transferring or rigid joints, determined using the same computer software as in Example 1. The beam length to deflection ratios were also calculated for each measured beam deflection and compared to a beam length to deflection ratio (L/D) of 180, equating to a maximum beam deflection of 0.7644 in. for this length of beam (137.75 in.). From these tests, it can be seen that for a load yielding a beam length to deflection ratio of 180, the joints supported a beam bearing a load of at least 4,700 lbs. One exception to the results related to the failure to properly anchor the test apparatus to the ground surface. Moreover, in most of these tests, the beam failed before the joint. And, for beam length to deflection ratios of 180 and higher, or deflections of 0.7644 inches and less, the beam more closely followed the model of a beam with moment-transferring joints than the model of a beam supported by simple joints. As shown in the table below as well as the graph in FIG. 30, the test results with the post-construction joints also more closely followed the model of a beam with moment-transferring joints at loads producing beam length to deflection ratios of less than 180.

| | *Test PT9-5/EPX | | **Test PT8-5/EPX | | ***Test PT7-5/EPX | | ****Test FR-555-01 | | Model Deflection | |
|---|---|---|---|---|---|---|---|---|---|---|
| Load (lbs.) | Deflection (in.) | L/D | Deflection (in.) | L/D | Deflection (in.) | L/D | Deflection (in.) | L/D | Simple (in.) | Moment (in.) |
| 0 | 0 | — | 0 | — | 0 | — | 0 | — | 0 | 0 |
| 700 | 0.196 | 703 | 0.14 | 984 | 0.157 | 877 | 0.157 | 877 | 0.316 | 0.115 |
| 2700 | 0.409 | 337 | 0.364 | 378 | 0.357 | 386 | — | — | 1.218 | 0.443 |
| 3200 | — | — | — | — | — | — | 0.608 | 227 | — | 0.525 |
| 3700 | 0.537 | 257 | 0.514 | 268 | 0.502 | 274 | 0.712 | 193 | 1.669 | 0.607 |
| 4700 | 0.673 | 205 | 0.642 | 215 | 0.642 | 215 | 0.903 | 153 | 2.12 | 0.771 |
| 5700 | 0.812 | 170 | 0.774 | 178 | 0.787 | 175 | 1.174 | 117 | 2.571 | 0.935 |
| 6700 | 0.999 | 138 | 0.939 | 147 | 0.936 | 147 | 1.412 | 98 | 3.022 | 1.098 |
| 7200 | — | — | — | — | — | — | 1.903 | 72 | — | 1.18 |
| 7700 | 1.123 | 123 | 1.104 | 125 | 1.087 | 127 | 2.053 | 67 | 3.473 | 1.262 |
| 8200 | — | — | — | — | — | — | 2.228 | 62 | — | 1.344 |
| 8700 | 1.268 | 109 | 1.294 | 106 | 1.255 | 110 | 2.362 | 58 | 3.924 | 1.426 |
| 9700 | 2.984 | 46 | 1.594 | 86 | 1.436 | 96 | 2.863 | 48 | 4.375 | 1.59 |
| 10700 | 3.382 | 41 | 3.029 | 45 | 1.636 | 84 | 3.273 | 42 | 4.826 | 1.754 |
| 11700 | 3.912 | 35 | 3.876 | 36 | 2.756 | 50 | 3.776 | 36 | 5.278 | 1.918 |
| 12700 | 4.253 | 32 | 4.074 | 34 | 3.247 | 42 | 4.218 | 33 | 5.729 | 2.082 |
| 13200 | — | — | — | — | — | — | 4.441 | 31 | — | 2.164 |
| 13700 | 4.782 | 29 | 4.474 | 31 | 3.291 | 42 | 4.715 | 29 | 6.18 | 2.246 |
| 14700 | 5.333 | 26 | 4.894 | 28 | — | — | — | — | 6.631 | 2.41 |
| 15700 | 5.732 | 24 | 5.274 | 26 | — | — | — | — | 7.082 | 2.574 |

-continued

| | *Test PT9-5/EPX | | **Test PT8-5/EPX | | ***Test PT7-5/EPX | | ****Test FR-555-01 | | Model Deflection | | |
|---|---|---|---|---|---|---|---|---|---|---|---|
| Load (lbs.) | Deflection (in.) | L/D | Deflection (in.) | L/D | Deflection (in.) | L/D | Deflection (in.) | L/D | Simple (in.) | L/D | Moment (in.) |
| 16700 | 6.161 | 22 | 5.664 | 24 | — | — | — | — | — | — | 2.738 |
| 17700 | 6.367 | 22 | — | — | — | — | — | — | — | — | 2.902 |

*Beam failure at about 18,400 lbs.
**Beam failure at about 16,000 lbs.
***Beam failure at about 23,000 lbs.
****No beam failure; frame lifted off ground.

EXAMPLE 5

Two other samples were prepared using 12 gauge stainless steel mounting plates. As in Example 4, the beams were 5×5 beams. In one sample, no adhesive was used; only tech screws were used; in the following table, the deflections for this sample are reported in the column with the heading "Mechanical Alone." In another sample, the joints were prepared using Magnobond 56 A and B epoxy and tech screws; after the epoxy had cured, the tech screws were removed and the sample tested as in the prior examples; the deflections for this sample are reported in the following table under the heading "Adhesive Alone." The results are also plotted on the graph of FIG. 30 The results for test FR-555-01 of Example 4 are repeated under the column headed "Adhesive & Mechanical" for purposes of comparison.

From the table and graph, it can be seen that the beam with the joints having combined adhesive and mechanical connectors and the beam with joints having adhesive alone more closely followed the model of a beam with rigid or moment-transferring joints than the model of a beam with simple supports or simple joints at least through the load that produced a length to deflection ratio (L/D) of 180 or greater, as well as at loads yielding lower L/D's. With the adhesive joint and combined adhesive and mechanical joint, there was no substantial relative movement between the beam and column through a load of at least the magnitude producing a length to deflection ratio of 180, as well as higher loads. Moreover, in constructing a tower with such joints, before the adhesive cures during construction, construction joints comprising the mechanical connections, mounting members, beam and columns should be able to support beam loads of up to at least 1500 pounds without the beam deflecting more than 0.7644 inches. After the adhesive has cured, post-construction joints defined by the cured adhesive or bonding material, column, beam and mounting member can support beam loads of more than about 3,700 lbs. without the beam deflecting more than 0.7644 inches. The post-construction complete adhesive and mechanical joint can support beam loads of more than 3700 lbs. without the beam deflecting more than 0.7644 in., and greater loads can be supported, with the deflections more closely following the model of a rigidly supported beam than the model of a simply supported beam. In the cases of both the "Mechanical Alone" and "Adhesive Alone" samples, the joints failed before the beams. In the case of the "Adhesive and Mechanical" sample, the beam failed at 19,500 lbs, without joint failure.

| | Adhesive & Mechanical Test FR 555-01 | | Mechanical Alone | | Adhesive Alone | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | 0 | — | 0 | — | 0 | — | 0 | 0 |
| 700 | 0.157 | 877 | 0.25 | 551 | 0.163 | 845 | 0.316 | 0.115 |
| 2700 | — | — | 0.896 | 154 | 0.5 | 276 | 1.218 | 0.443 |
| 3200 | 0.608 | 227 | — | — | — | — | 1.443 | 0.525 |
| 3700 | 0.712 | 193 | 1.226 | 112 | 0.699 | 197 | 1.699 | 0.607 |
| 4700 | 0.903 | 153 | 1.531 | 90 | 0.924 | 149 | 2.12 | 0.771 |
| 5700 | 1.174 | 117 | 1.891 | 73 | 1.53 | 90 | 2.571 | 0.935 |
| 6700 | 1.412 | 98 | 2.216 | 62 | 1.93 | 71 | 3.022 | 1.098 |
| 7200 | 1.903 | 72 | — | — | — | — | 3.248 | 1.18 |
| 7700 | 2.053 | 67 | 2.529 | 54 | — | — | 3.473 | 1.262 |
| 8200 | 2.228 | 62 | | | — | — | 3.699 | 1.344 |
| 8700 | 2.362 | 58 | 2.876 | 48 | — | — | 3.924 | 1.426 |
| 9700 | 2.863 | 48 | 3.191 | 43 | — | — | 4.375 | 1.59 |
| 10700 | 3.273 | 42 | — | — | — | — | 4.826 | 1.754 |
| 11700 | 3.776 | 36 | — | — | — | — | 5.278 | 1.918 |
| 12700 | 4.218 | 33 | — | — | — | — | 5.729 | 2.082 |
| 13200 | 4.441 | 31 | — | — | — | — | 5.924 | 2.164 |
| 13700 | 4.175 | 29 | — | — | — | — | 6.18 | 2.246 |

EXAMPLE 6

A sample was prepared using two 5×5 columns, one 5×5 beam, and four 10 gauge stainless steel mounting plates. The test frame was constructed as in previous examples using Magnobond 56 A and B epoxy, tech screws and through bolts. The test frame was tested under increasing loads, measuring the deflection of the beam at the center. In the table below, the measured deflections are compared to the simple and moment models of the previous examples for a 5×5 beam.

The results below illustrate a difference in the thickness or stiffness of the mounting member. In the frame with the 12 gauge stainless steel mounting plate, the beam deflected less than the beam in the frame with the 10 gauge stainless steel mounting plate at loads above 700 lbs.

| Load | *Test FR-555-02 | | Model Deflection | |
|---|---|---|---|---|
| (lbs.) | Deflection (in.) | L/D | Simple (in.) | Moment (in.) |
| 0 | 0 | — | 0 | 0 |
| 700 | 0.157 | 877 | 0.316 | 0.115 |
| 2700 | 0.47 | 293 | 1.218 | 0.443 |
| 3700 | 0.658 | 209 | 1.699 | 0.607 |
| 4700 | 0.832 | 166 | 2.12 | 0.771 |

-continued

| Load | *Test FR-555-02 | | Model Deflection | |
|---|---|---|---|---|
| (lbs.) | Deflection (in.) | L/D | Simple (in.) | Moment (in.) |
| 5700 | 1.098 | 125 | 2.571 | 0.935 |
| 6700 | 1.3 | 106 | 3.022 | 1.098 |
| 7700 | 1.5 | 92 | 3.473 | 1.262 |
| 8700 | 1.772 | 78 | 3.924 | 1.426 |
| 9700 | 2.244 | 61 | 4.375 | 1.59 |
| 10700 | 3.019 | 46 | 4.826 | 1.754 |
| 11700 | 4.001 | 34 | 5.278 | 1.918 |
| 12700 | 5.112 | 27 | 5.279 | 2.082 |
| 13700 | 5.509 | 25 | 6.18 | 2.246 |
| 14700 | 6.26 | 22 | 6.631 | 2.41 |
| 15700 | 6.428 | 21 | 7.082 | 2.574 |

*Beam failure at about 19,500 lbs.

EXAMPLE 7

Figure 31:
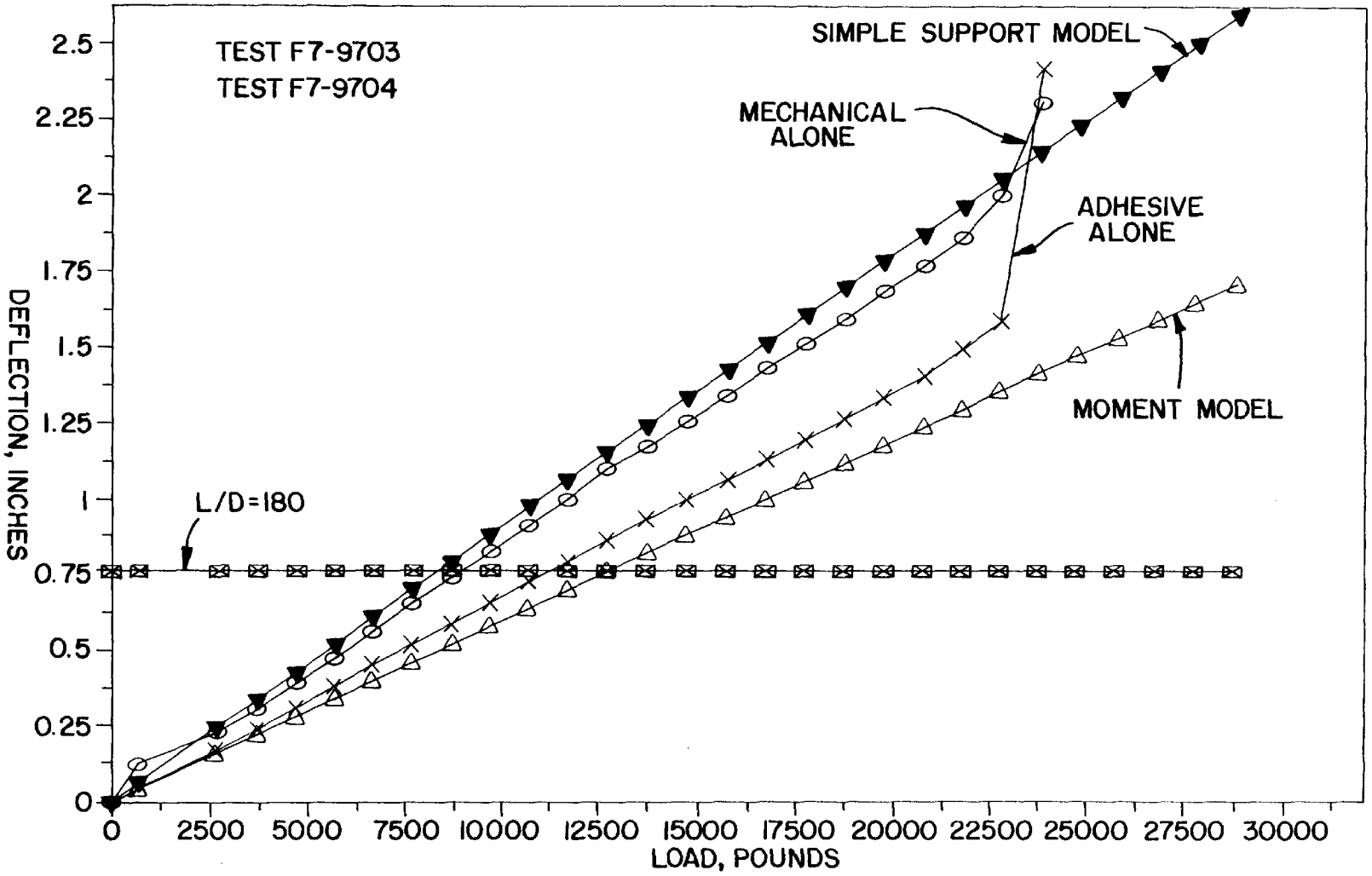
FIG. 31 is a graph of test results from the test set-up of FIG. 25 and calculated models for a 5×10 beam and 5×5 columns with fiber reinforced plastic mounting plates.

Two samples were prepared using two 5×5 columns, one 5×10 beam, and four one-quarter inch thick fiber reinforced plastic mounting plates. The fiber reinforced plastic plates were common structural pieces with glass fibers and resin. In one sample, no adhesive was used; only mechanical fasteners, or tech screws, were used; in the following table, the deflections for this sample are reported in the column with the heading "Mechanical Alone." In another sample, the joints were prepared using Magnobond 56 A and B epoxy and tech screws as the mechanical fasteners; after the epoxy had cured, the tech screws were removed and the sample was tested under increasing loads as in previous examples, measuring deflections at the various loads. The deflections for this sample are reported in the following table under the heading "Adhesive Alone." No separate tests of the combined adhesive and mechanical fasteners were performed, as indicated by "N/A" under the column heading "Adhesive & Mechanical". The results are also plotted on the graph of FIG. 31 and are identified as Test F7-9703 and Test F7-9704 on that graph. Model Deflections for the simple and moment-transferring joints were the same as for Example 1.

From the table and graph, it can be seen that in the test joint for the adhesive, the beam deflections more closely followed the model of a beam with rigid or moment-transferring joints than the model of a beam with simple supports or simple joint through the load that produced a beam length to deflection ratio (L/D) of 180 or greater, and through greater loads that produced greater deflections. Such a joint should have no substantial relative movement between the beam and column through a load of at least the magnitude producing a beam length to deflection ratio of 180. Moreover, in constructing such a tower, before the adhesive cures, the mechanical connection should be able to provide a construction joint that can support the beam bearing a load of up to at least about 8700 pounds without the beam deflecting more than 0.7644 inches. After the bonding material has cured, the cured adhesive, mounting plate, beam and column alone can define a post-construction joint that can support the beam bearing loads of about 10,700 lbs. without the beam deflecting more than 0.7644 inches. In the cases of both the "Mechanical Alone" and "Adhesive Alone" samples, the joints failed before the beams.

| | Adhesive & Mechanical | | Mechanical Alone | | Adhesive Alone | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | N/A | | 0 | — | 0 | — | 0 | 0 |
| 700 | N/A | | 0.126 | 1093 | 0.046 | 2995 | 0.063 | 0.042 |
| 2700 | N/A | | 0.233 | 591 | 0.166 | 830 | 0.245 | 0.161 |
| 3700 | N/A | | 0.305 | 452 | 0.237 | 581 | 0.335 | 0.221 |
| 4700 | N/A | | 0.394 | 350 | 0.308 | 447 | 0.426 | 0.281 |
| 5700 | N/A | | 0.473 | 291 | 0.38 | 363 | 0.517 | 0.34 |
| 6700 | N/A | | 0.561 | 246 | 0.452 | 305 | 0.607 | 0.4 |
| 7700 | N/A | | 0.654 | 211 | 0.521 | 264 | 0.698 | 0.46 |
| 8700 | N/A | | 0.74 | 186 | 0.588 | 234 | 0.789 | 0.519 |
| 9700 | N/A | | 0.824 | 167 | 0.657 | 210 | 0.879 | 0.579 |
| 10700 | N/A | | 0.909 | 152 | 0.728 | 189 | 0.97 | 0.639 |
| 11700 | N/A | | 0.995 | 138 | 0.791 | 174 | 1.061 | 0.698 |
| 12700 | N/A | | 1.097 | 126 | 0.859 | 160 | 1.151 | 0.758 |
| 13700 | N/A | | 1.171 | 118 | 0.931 | 148 | 1.242 | 0.818 |
| 14700 | N/A | | 1.256 | 110 | 0.995 | 138 | 1.333 | 0.877 |
| 15700 | N/A | | 1.339 | 103 | 1.061 | 130 | 1.423 | 0.937 |
| 16700 | N/A | | 1.43 | 96 | 1.128 | 122 | 1.514 | 0.997 |
| 17700 | N/A | | 1.51 | 91 | 1.195 | 115 | 1.604 | 1.056 |
| 18700 | N/A | | 1.59 | 87 | 1.263 | 109 | 1.695 | 1.116 |
| 19700 | N/A | | 1.683 | 82 | 1.331 | 103 | 1.786 | 1.176 |
| 20700 | N/A | | 1.769 | 78 | 1.408 | 98 | 1.876 | 1.236 |
| 21700 | N/A | | 1.866 | 74 | 1.497 | 92 | 1.967 | 1.295 |
| 22700 | N/A | | 2.005 | 69 | 1.585 | 87 | 2.058 | 1.355 |
| 23700 | N/A | | 2.313 | 60 | 2.431 | 57 | 2.148 | 1.415 |
| 24700 | N/A | | — | — | — | — | 2.239 | 1.474 |
| 25700 | N/A | | — | — | — | — | 2.33 | 1.534 |
| 26700 | N/A | | — | — | — | — | 2.42 | 1.594 |
| 27700 | N/A | | — | — | — | — | 2.511 | 1.653 |
| 28700 | N/A | | — | — | — | — | 2.602 | 1.713 |
| 29700 | N/A | | — | — | — | — | 2.692 | 1.773 |
| 30700 | N/A | | — | — | — | — | 2.783 | 1.832 |
| 31700 | N/A | | — | — | — | — | 2.874 | 1.892 |

EXAMPLE 8

Figure 32:
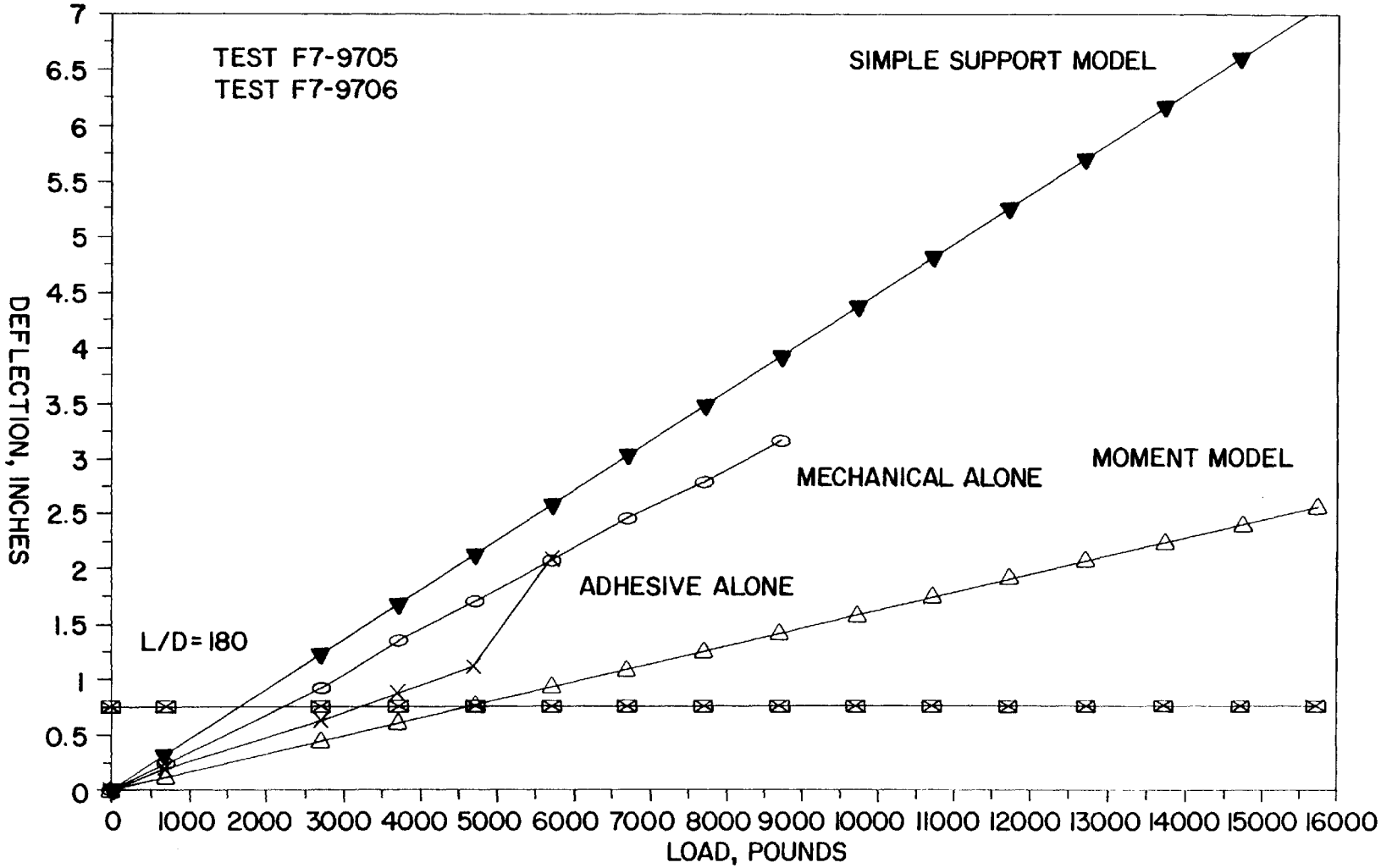
FIG. 32 is a graph of test results from the test set-up of FIG. 25 and calculated models for a 5×5 beam and 5×5 columns with fiber reinforced plastic mounting plates.

Two samples were prepared using two 5×5 columns, one 5×5 beam, and four one-quarter inch thick fiber reinforced plastic mounting plates. The fiber reinforced plastic plates were common structural pieces with glass fibers and thermoset polyester resin. In one sample, no adhesive was used; only mechanical fasteners, or tech screws, were used; in the following table, the deflections for this sample are reported in the column with the heading "Mechanical Alone." In another sample, the joints were prepared using Magnobond 56 A and B epoxy and tech screws; after the epoxy had cured, the tech screws were removed and the sample tested as in Example 4; the deflections for this sample are reported in the following table under the heading "Adhesive Alone." No separate tests of the combined adhesive and mechanical fasteners were performed, as indicated by the reference "N/A" in the following table. The results are also plotted on the graph of FIG. 32 and the tests are identified as Test F7-9705 and Test F7-9706 on that graph. Model Deflections for the simple support and moment transferring joint were the same as for Example 4.

From the table and graph, it can be seen that the test beam having the joints with adhesive alone more closely followed the model of a beam with rigid or moment-transferring joints than the model of a beam with simple supports or joints through the load that produced a beam length to deflection ratio (L/D) of 180 or greater, as well as at higher loads producing greater deflections. Such a joint should have no substantial relative movement between the beam and column through a load of at least the magnitude producing a beam length to deflection ratio of 180. Moreover, in constructing such a tower, before the bonding material or adhesive cures, the mechanical connection between the mounting plate and beam and column defines a construction joint that should be able to support the beam bearing a load of up to at least about 2000 pounds without the beam deflecting more than 0.7644 inches. After the epoxy or other bonding material or adhesive has cured, the cured adhesive, mounting plate, beam and columns alone can define post-construction joints that can support the beam bearing loads of about 3,000 lbs. without the beam deflecting more than 0.7644 inches. In the cases of both the "Mechanical Alone" and "Adhesive Alone" samples, the joints failed before the beams.

| | Adhesive & Mechanical | | Mechanical Alone | | Adhesive Alone | | Model Deflection | |
|---|---|---|---|---|---|---|---|---|
| Load (lbs.) | Deflection (in.) | L/D | Deflection (in.) | L/D | Deflection (in.) | L/D | Simple (in.) | Moment (in.) |
| 0 | N/A | | 0 | — | 0 | — | 0 | 0 |
| 700 | N/A | | 0.23 | 599 | 0.183 | 753 | 0.316 | 1.115 |
| 2700 | N/A | | 0.914 | 151 | 0.624 | 221 | 1.218 | 0.443 |
| 3700 | N/A | | 1.352 | 102 | 0.871 | 158 | 1.669 | 0.607 |
| 4700 | N/A | | 1.691 | 81 | 1.12 | 123 | 2.12 | 0.771 |
| 5700 | N/A | | 2.074 | 66 | 2.119 | 65 | 2.571 | 0.935 |
| 6700 | N/A | | 2.446 | 56 | — | — | 3.022 | 1.098 |
| 7700 | N/A | | 2.782 | 50 | — | — | 3.473 | 1.262 |
| 8700 | N/A | | 3.157 | 44 | — | — | 3.924 | 1.426 |
| 9700 | N/A | | — | — | — | — | 4.375 | 1.59 |
| 10700 | N/A | | — | — | — | — | 4.826 | 1.754 |
| 11700 | N/A | | — | — | — | — | 5.278 | 1.918 |
| 12700 | N/A | | — | — | — | — | 5.729 | 2.082 |
| 13700 | N/A | | — | — | — | — | 6.18 | 2.246 |
| 14700 | N/A | | — | — | — | — | 6.631 | 2.41 |
| 15700 | N/A | | — | — | — | — | 7.082 | 2.574 |

EXAMPLE 9

A cooling tower made in accordance with the present invention would have joints defined by the mechanical fasteners, mounting plates, columns and beams before the adhesive or bonding material sets up or cures. These joints may be characterized as construction joints, and are mechanical joints for supporting a design construction load. Design construction loads include dead loads and live loads, the dead loads including those present at least 70% of the time, and the live loads including shorter term loads such as those from ice, snow, personnel, equipment, wind and seismic loads.

The construction dead load to be supported by such mechanical or construction joints would include the weight of the beam itself and, depending on the cure time for the adhesive, the weight of the dry fill material at the fill level of the cooling tower, and the weight of the dry water distribution system at the next level, and the weight of the roof deck, fan and shroud at the next higher level, along with the weights of the supporting lintels. For example, for a twelve foot by twelve foot bay, the joint would need to support one-half the weight of the beam, the total weight of which may be on the order of 94 pounds. The lintels may be relatively lightweight, adding about 90–120 lbs. to the load, depending on the number of lintels used. And taking, for example, a fill material having a dry load of 2 lbs./ft.$^3$, a four foot high fill level would provide a load of only about 864 lbs. For live construction loads, considering the relatively small surface area of the beams and columns exposed to wind loads prior to the addition of the cladding, on the order of about 9.57 ft.$^2$ for a 5×10 beam, wind loads of even 15–20 lb./ft.$^2$ should not add appreciably to any deflection. Any of the joints reported under the heading "Mechanical Only" in Examples 2, 5, 7 and 8 would be capable of supporting a beam bearing such loads without the beam deflecting more than 0.7644 inches. At loads on the order of 1000 lbs., the group of mechanical fasteners used should provide sufficient stiffness to prevent the excessive rotation of the connection at the joint. Even a seismic load of 0.05 g., for example, for the above examples, would provide a load of about 474 pounds at each joint, well within the capacity of the mechanical or construction joint.

EXAMPLE 10

A cooling tower made in accordance with the present invention may be expected to have post-construction dead loads at the fill level comprised of the load of the wet fill and the weights of the lintels and beams. At the water distribution level, the post-construction dead loads would comprise the weight of the lintels and beams and the weight of the water-filled water distribution system with drift eliminators. At the deck support level, the post-construction dead load would comprise the weights of the beams, lintels, roof deck, fan shroud, fan, motor, and railing. The post-construction dead loads would include those expected to be experienced over the life of the tower, or at least 70% of the time. Post-construction live loads are shorter term and at these levels would comprise wind loads, seismic loads, and other potential short term loads such as ice, snow and the weight of personnel and equipment. All or some of these post-construction loads would be considered part of the post-construction load to be borne by a beam and part of a post-construction moment exerted on or transferred by a rigid joint. Typical quantities for such loads for a structure like that shown in FIGS. 2–3, with 12×12 bays, with each beam to be supported by two joints, could comprise the following range of values:

| Tower Level | Type of Load | Exemplary Ranges of Loads |
|---|---|---|
| Fill Level | Beam(5 × 5 - 5 × 10) | 56–94 lbs. |
| | Lintels (3-4) | 90–120 lbs. |
| | Wet fill (5.72 lbs./ft.$^3$, 1 ft.–7 ft. high) | 824–5766 lbs. |
| | Wind (10–20 psf) | 28,000–56,000 in-lbs. |
| | Seismic (0.05–0.3 g.) | 5400–32,640 in-lbs. |
| Water Distribution Level | Beam(5 × 5 - 5 × 10) | 56–94 lbs. |
| | Lintels (3 - 4) | 60–90 lbs. |
| | Full distribution system (with drift eliminators) | 2450 lbs. |
| | Wind (10–20 psf) | 7800–15,600 in-lbs. |
| | Seismic (0.05–0.3 g.) | 2040–12,120 in-lbs. |
| Deck Level | Beam(5 × 5 - 5 × 10) | 56–94 lbs. |
| | Lintels (3 - 4) | 60–120 lbs. |
| | Deck | 720 lbs. |
| | Fan | 400–850 lbs. |
| | Motor | 500–1500 lbs. |
| | Railing (5 lb./ft.) | 72 lbs. |
| | Wind(10–20 psf) | 3120–6240 in-lbs. |
| | Seismic (0.05–0.3 g.) | 960–5760 in-lbs. |

Design post-construction moments at the joints can be determined from the load ranges given in pounds. It should be understood that the above values are given for purposes of illustration only, and that the values for all of the loads and types of loads can vary depending on the circumstances, such as geographic location of the cooling tower. Moreover, design moment loads at the joints may be determined using any method acceptable in the art. The design moment loads can be compared to the moment capacities of the joints to determine that the joints are capable of bearing design post-construction loads.

To determine the moment capacity of the various tested joints, for comparison with the anticipated loads, known formulae, models and computer software may be used. One method of estimating moment capacities of joints may use the above data and similar tests of deflection under increasing loading, compared to the deflections for a model beam with moment-transferring joints at its ends. From the above examples, at least up to loads producing beam length to deflection ratios of 180, the beams' deflections were similar to model deflections for beams supported by moment-transferring joints. Where the test deflections substantially followed the model deflections, the moment capacity of the test joint may be assumed to be as great as the model moment. Since in all of the tests of stainless steel mounting plates the test deflections closely followed the model deflections up to and beyond the load that produced a length to deflection ratio of 180, the moment capacities of these joints may reasonably be assumed to be the value of the model moment at those loads. Thus, if the design criteria for length to deflection for the beam is 180 or more, such a joint should have a moment transferring capacity close to the model of a moment transferring joint. The value of the moments for the model moment-transferring frame may be calculated for the load producing a beam length to deflection ratio of 180, as well as for loads producing higher or lower L/D's. In the case of the 5×5 beam of Test FR-555-02, that load was about 4660 lbs., producing a moment of about 56,760 in-lbs., calculated using RISA-3D software. In the case of the 5×10 beam of Test PT3-10/EPX, the load at L/D 180 was 12,800 lbs., equating with a moment of 88,920 in-lbs., calculated using RISA-3D software. Such joints should be capable of withstanding potential wind loads at different locations in the sample tower, comparing the range of values for these design moment loads in the table, without racking of the structure and without using cross-bracing in most circumstances. At some locations in the tower, such as the air intake level 44, cross-braces 140 may be used as shown in the embodiment illustrated in FIGS. 5 and 6.

Figure 33:
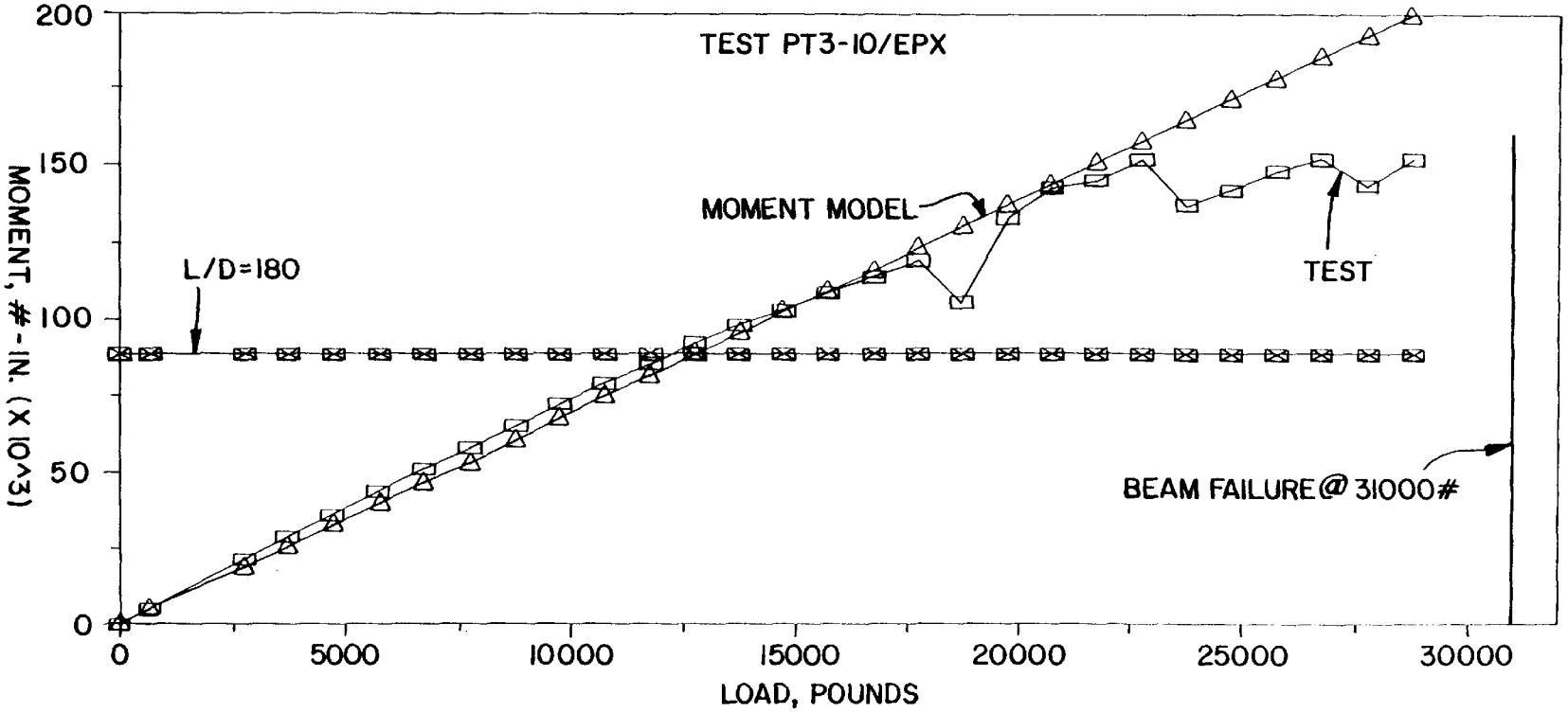
FIG. 33 is a graph of the moment calculated for a moment transferring model and estimated moments for joints between a 5×10 beam and 5×5 columns with stainless steel mounting plates.
Figure 34:
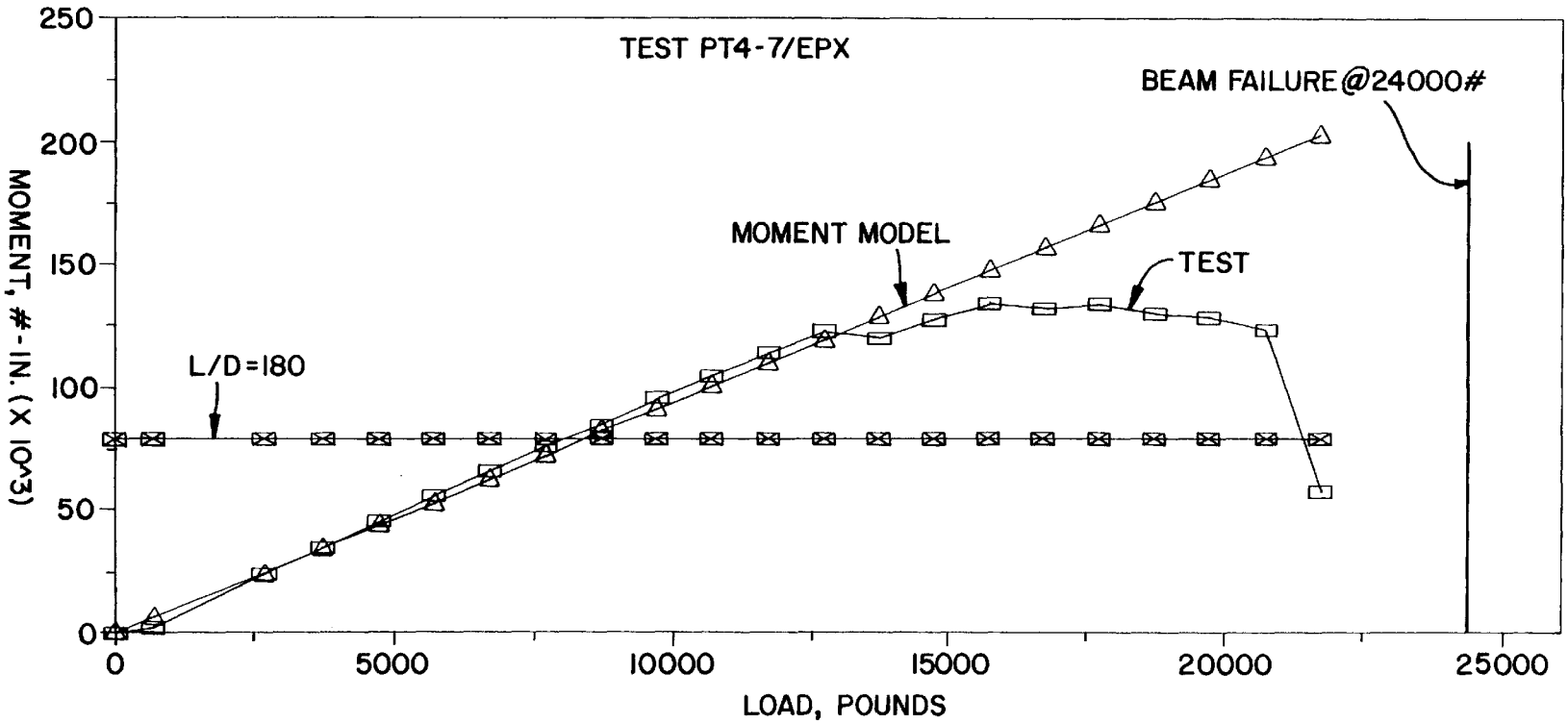
FIG. 34 is graph of the moment calculated for a moment transferring model and estimated moments for joints between a 5×7 beam and 5×5 columns with stainless steel mounting plates.
Figure 35:
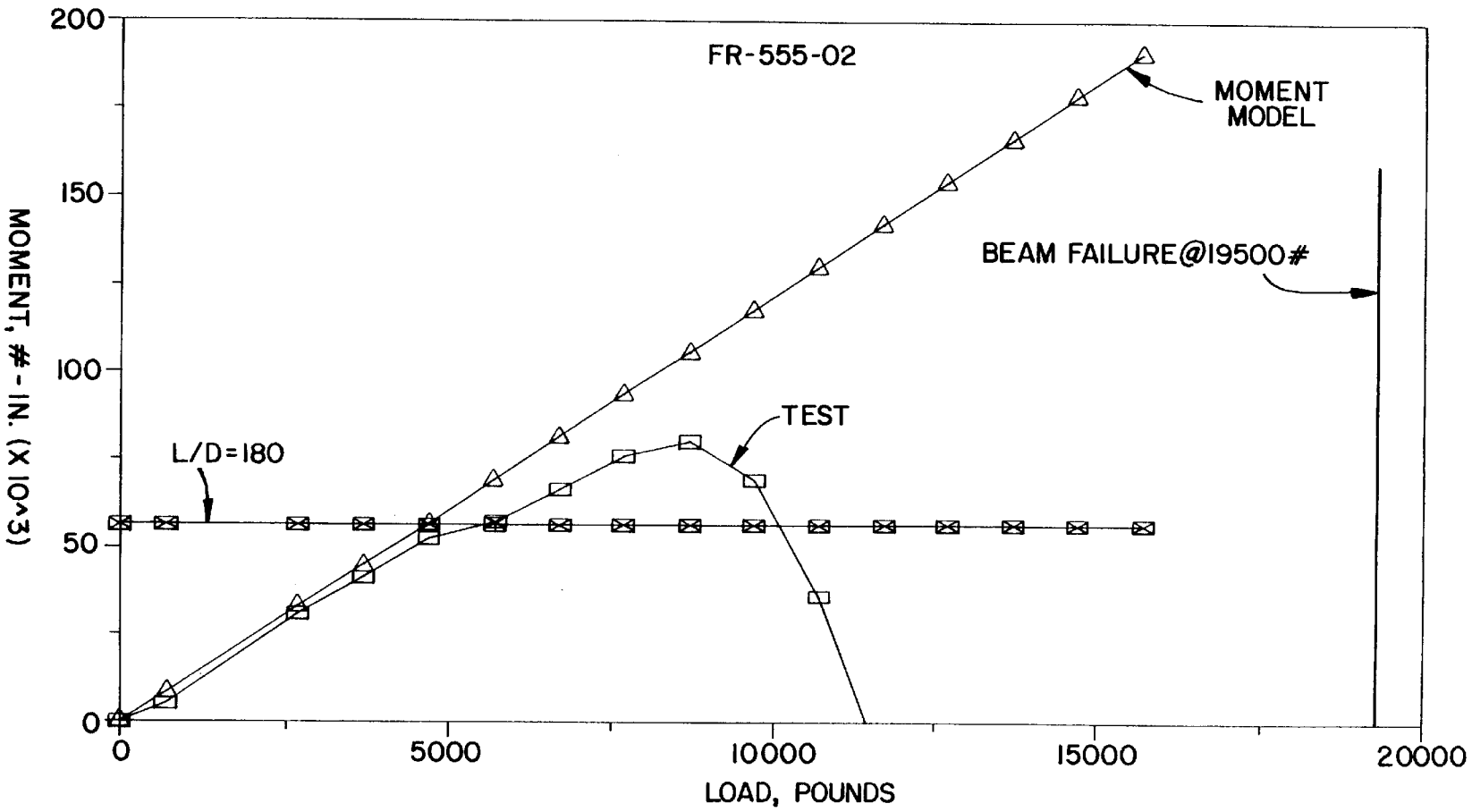
FIG. 35 is graph of the moment calculated for a moment transferring model and estimated moments for joints between a 5×5 beam and 5×5 columns with stainless steel mounting plates.

As shown in FIGS. 28–32, at some load, the deflections of the tested beams begin to deviate from the deflections expected for a model beam supported by a moment transferring joint. As the differences between the measured deflection values and model deflection values increase, the joint may be characterized as being less like a moment transferring joint, and the moment transferred would decline, although the joint would be expected to bear some moment at some points where it deviates from the moment model. One method of estimating the moment capacity of the tested joints involves determining the difference between the measured deflection and the moment model deflection. This difference between the measured deflection and the moment model deflection may be reasonably expected to relate to a similar difference between loads, so that the change in load to create the change in deflection may be determined from a graph such as those of FIGS. 28–30, from software such as RISA-3D, or from other sources. This difference in loads may then be subtracted from the moment model load to determine an estimated equivalent load, that is, the portion of the load that may reasonably be expected to be creating a moment at the joint. The moment may then be estimated using this estimated equivalent load. This procedure has been followed to determine the values reported in the tables below, and graphed in the graphs of FIGS. 33–35. FIG. 33 represents the moments estimated at the joints of the 5×10 beam of Test PT3-10/EPX and the model moments for moment transferring joints for a beam of that size, and the moment at a L/D of 180, determined from the load that would produce such a deflection in the moment model. FIG. 34 represents the moments estimated for the joints of the 5×7 beam of Test PT4-7/EPX and the model moments for moment transferring joints for a beam of that size, and the moment at a L/D of 180, determined from the load that would produce such a deflection in the moment model. FIG. 35 represents the moments estimated at the joints of the 5×5 beam of Test FR-555-02 and the model moments for moment transferring joints for a beam of that size, and the moment at a L/D of 180, determined from the load that would produce such a deflection in the moment model. In the tables, the column headed "Actual Load" is the load applied by the test apparatus. The column headed "Moment Model" gives the moment calculated for the model moment transferring joint at each load. The column headed "Δy" is the difference between the measured deflection at each load and the load for the moment transferring model. The column headed "Adjusted Deflection" is the deflection for the model moment transferring joint less the Δy amount. The column headed "Adjusted Load" is the amount of load that would produce the "Adjusted Deflection" in the moment transferring model, determined using the RISA-3D software and from the graphs of deflection versus load. Using this value of "Adjusted Load", the value of the moment is calculated using the RISA-3D software and reported in the column headed "Estimated Moment". This same procedure was used in producing all three of the following tables for the 5×10, 5×7 and 5×5 beams. The RISA-3D software was also used to produce the graphs of FIGS. 33–35 showing the estimated moments.

These estimated moments may be used to determine the moment capacity of the joints throughout the range of expected loads. These moment capacities may be compared to the anticipated moments to ensure that the post-construction joints are capable of bearing substantially all design post-construction loads on the joints.

It should be understood that other methods may be used to estimate the moment capacities of the joints. As the table and these graphs illustrate, joints between columns and 5, 7 and 10 inch beams have varying moment capacities, and may be used at various locations in the cooling tower structure and should be able to carry the anticipated moment load and transfer the moments to the columns that resist lateral loading or racking of the structure. Moreover, with such rigid connections, a particular design L/D for a beam may be met under higher loads than with a non-rigid connection or joint.

It will also be understood by those in the art that the tests, model and calculations can be made more or less complex, and that the methods used to produce the data in the tables and graphs of this application can be adjusted to account for experimental error and other factors, such as the change in flexural modulus of the beams with changes in load. Moreover, some of the test results show deflections less than the model moment transferring joint, a result that would not occur; some adjustments in calculations and estimates may be made to account for these variations.

| Actual Load (lbs.) | Model Moment (in.-lbs.) | Ay (in.) | Adjusted Deflection (in.) | Adjusted Load (lbs.) | Estimated Moment (in.-lbs.) |
|---|---|---|---|---|---|
| | | Test PT3-10/EPX | | | |
| 700 | 4920 | −0.0002 | 0.0440 | 737 | 5121 |
| 2700 | 18720 | −0.020 | 0.1810 | 3032 | 21066 |
| 3700 | 25680 | −0.024 | 0.2450 | 4104 | 28515 |
| 4700 | 32640 | −0.028 | 0.3090 | 5176 | 35964 |
| 5700 | 39600 | −0.032 | 0.3720 | 6232 | 43296 |
| 6700 | 46560 | −0.035 | 0.4350 | 7287 | 50629 |
| 7700 | 53520 | −0.036 | 0.4960 | 8309 | 57728 |
| 8700 | 60480 | −0.039 | 0.5580 | 9347 | 64945 |
| 9700 | 67440 | −0.040 | 0.6190 | 10369 | 72044 |
| 10700 | 74400 | −0.036 | 0.6750 | 11307 | 78562 |
| 11700 | 81240 | −0.034 | 0.7320 | 12262 | 85196 |
| 12700 | 88200 | −0.030 | 0.7880 | 13200 | 91714 |
| 13700 | 95160 | −0.020 | 0.8380 | 14038 | 97533 |
| 14700 | 102120 | −0.004 | 0.8810 | 14758 | 102538 |
| 15700 | 109080 | 0.006 | 0.9310 | 15596 | 108357 |
| 16700 | 116040 | 0.020 | 0.9770 | 16366 | 113711 |
| 17700 | 123000 | 0.036 | 1.0200 | 17086 | 118716 |
| 18700 | 129960 | 0.208 | 0.9080 | 15210 | 105680 |
| 19700 | 136920 | 0.040 | 1.1360 | 19030 | 132217 |
| 20700 | 143880 | 0.011 | 1.2250 | 20521 | 142575 |
| 21700 | 150720 | 0.049 | 1.2460 | 20872 | 145019 |
| 22700 | 157680 | 0.052 | 1.3030 | 21827 | 151654 |
| 23700 | 164640 | 0.235 | 1.1800 | 19767 | 137338 |
| 24700 | 171600 | 0.253 | 1.2210 | 20454 | 142110 |
| 25700 | 178560 | 0.260 | 1.2740 | 21341 | 148278 |
| 26700 | 185520 | 0.286 | 1.3080 | 21911 | 152236 |
| 27700 | 192480 | 0.419 | 1.2340 | 20671 | 143623 |
| 28700 | 199440 | 0.404 | 1.3090 | 21928 | 152352 |
| 29700 | 206400 | 0.390 | 1.383() | 23167 | 160965 |
| 30700 | 213360 | 0.419 | 1.4130 | 23670 | 164456 |
| 31700 | 220320 | 0.615 | 1.2770 | 21392 | 148627 |
| | | Test PT4-7/EPX | | | |
| 700 | 6600 | 0.046 | 0.0170 | 188 | 1765 |
| 2700 | 25320 | 0.010 | 0.2340 | 2591 | 24292 |
| 3700 | 34680 | −0.001 | 0.3350 | 3710 | 34777 |
| 4700 | 44040 | −0.011 | 0.4350 | 4817 | 45158 |
| 5700 | 53400 | −0.021 | 0.5360 | 5936 | 55643 |
| 6700 | 62760 | −0.028 | 0.6330 | 7010 | 65713 |
| 7700 | 72240 | −0.033 | 0.7280 | 8062 | 75575 |
| 8700 | 81600 | −0.030 | 0.8160 | 9037 | 84711 |
| 9700 | 90960 | −0.037 | 0.9130 | 10111 | 94780 |
| 10700 | 100320 | −0.036 | 1.0020 | 11096 | 104020 |
| 11700 | 109680 | −0.034 | 1.0900 | 12071 | 113155 |
| 12700 | 119040 | −0.029 | 1.1760 | 13023 | 122083 |
| 13700 | 128400 | 0.086 | 1.1510 | 12746 | 119488 |
| 14700 | 137760 | 0.103 | 1.2240 | 13555 | 127066 |
| 15700 | 147240 | 0.136 | 1.2820 | 14197 | 133087 |
| 16700 | 156600 | 0.242 | 1.2660 | 14020 | 131426 |
| 17700 | 165960 | 0.312 | 1.2860 | 14241 | 133502 |
| 18700 | 175320 | 0.442 | 1.2460 | 13799 | 129350 |
| 19700 | 184680 | 0.544 | 1.2350 | 13677 | 128208 |
| 20700 | 194040 | 0.681 | 1.1880 | 13156 | 123329 |
| 21700 | 203400 | 1.409 | 0.5500 | 6091 | 57097 |
| | | Test FR-555-02 | | | |
| 700 | 8520 | 0.042 | 0.0730 | 445 | 5423 |
| 2700 | 32880 | 0.027 | 0.4160 | 2537 | 30901 |
| 3700 | 45120 | 0.051 | 0.5560 | 3390 | 41300 |
| 4700 | 57240 | 0.061 | 0.7100 | 4329 | 52740 |
| 5700 | 69480 | 0.163 | 0.7720 | 4707 | 57345 |
| 6700 | 81600 | 0.202 | 0.8960 | 5463 | 66556 |
| 7700 | 93840 | 0.238 | 1.0240 | 6244 | 76064 |
| 8700 | 105960 | 0.346 | 1.0800 | 6585 | 80224 |
| 9700 | 118200 | 0.654 | 0.9360 | 5707 | 69527 |
| 10700 | 130320 | 1.265 | 0.4890 | 2982 | 36324 |
| 11700 | 142560 | 2.083 | −0.1650 | −1006 | −12256 |
| 12700 | 154680 | 3.030 | −0.9480 | −5780 | −70419 |
| 13700 | 166920 | 3.263 | −1.0170 | −6201 | −75544 |
| 14700 | 179040 | 3.850 | −1.4400 | −8780 | −106965 |
| 15700 | 191280 | 3.854 | −1.2800 | −7805 | −95080 |

While these tests were of vertical loading of the beam, rather than of lateral loading, as would be expected under windy conditions, for example, it is expected that the tests provide a reasonable estimate of the moment capacity of the joints about both horizontal and vertical axes. Other tests, models, estimates and formulae may be used to evaluate the moment capacities of the joints under lateral loading, as well as under vertical loading.

In some of the foregoing examples, comparisons have been made between the tested joints and model joints for both simple supports and moment-transferring joints. These comparisons illustrate that the tested beams with joints having adhesive alone and the beams with joints having both adhesive and mechanical fasteners more closely follow the models of moment-transferring joints or connections than the simple support models up to certain loads, and that these loads generally exceeded criteria such as, for example, the loads corresponding with a minimum L/D for the beam. The L/D for the beam may be 180 or some other amount, as will be understood by those in the art. It should be understood that some of the examples provide one means of showing that the illustrated joints are moment-transferring; other models, modeling methods, formulae, and measurements and characteristics may be used to determine whether a joint is a moment-transferring one, that is whether it is rigid. For example, if the angle between the beam and column at a joint in a structure is substantially constant under design loads, that joint is a rigid, moment-transferring joint for the purposes of the present invention. Moreover, if a joint between a beam and a column includes a mounting member bonded to both the beam and the column, and the beam bears its design dead load without deflecting substantially more than a model rigidly supported beam, without load-bearing cross-bracing across the column and beam defining the joint, the joint may be considered a moment-transferring joint. As will be understood by those in the art, other criteria may also be used to determine whether a joint is substantially moment-transferring.

While only specific embodiments of the invention have been described, it is apparent that various additions and modifications can be made thereto, and various alternatives can be selected. It is, therefore, the intention in the appended claims to cover all such additions, modifications and alternatives as may fall within the true scope of the invention.

We claim:

1. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

a first joint comprising:

mounting surfaces on the first column and the beam;

a first mounting member having a mounting surface facing the mounting surfaces of the first column and the beam;

a mechanical fastener extending from the first mounting member to the first column;

a mechanical fastener extending from the first mounting member to the beam; and bonding material disposed between the mounting surfaces of the first column and first mounting member and between the mounting surfaces of the beam and first mounting member;

a second joint comprising:

mounting surfaces on the second column and the beam;

a second mounting member having a mounting surface facing the mounting surfaces of the second column and the beam;

a mechanical fastener extending from the second mounting member to the second column;

a mechanical fastener extending from the second mounting member to the beam; and bonding material disposed between the mounting surfaces of the second column and second mounting member and between the mounting surfaces of the beam and second mounting member;

wherein at least one of the joints has a design load capacity without cross bracing that is at least as great as the design load capacity of one of the frame members.

2. The cooling tower of claim 1 wherein the mounting surfaces of the beam, the first and second columns and first and second mounting members are substantially vertical and wherein the plurality of frame members further includes a second beam and a third column, the first and second beams being substantially horizontal and substantially perpendicular to each other, the second beam extending between the first column and the third column, the cooling tower further including:

a third joint comprising:

substantially vertical mounting surfaces on the second beam and the third column;

a third mounting member having a substantially vertical mounting surface facing the mounting surfaces of the third column and the second beam;

a mechanical fastener extending from the third mounting member to the third column;

a mechanical fastener extending from the third mounting member to the second beam; and bonding material disposed between the mounting surfaces of the third column and third mounting member and between the mounting surfaces of the second beam and third mounting member;

a fourth joint comprising:

a substantially vertical mounting surface on the second beam and an additional substantially vertical mounting surface on the first column, the additional mounting surface of the first column being substantially perpendicular to the mounting surface of the first column at the first joint;

a fourth mounting member having a substantially vertical mounting surface substantially perpendicular to the mounting surface of the first mounting member and facing the mounting surface of the second beam and the additional mounting surface of the first column;

a mechanical fastener extending from the fourth mounting member to the first column;

a mechanical fastener extending from the fourth mounting member to the second beam; and bonding material disposed between the mounting surface of the fourth mounting member and the additional mounting surface of the first column and between the mounting surfaces of the second beam and fourth mounting member;

wherein at least one of the third and fourth joints has a design load capacity without cross bracing that is at least as great as the design load capacity of one of the frame members.

3. The cooling tower of claim 2 wherein the distance between the centerlines of the first and second columns is greater than four feet and the distance between the centerlines of the first and third columns is greater than four feet.

4. The cooling tower of claim 3 wherein the distance between the centerlines of the first and second columns is greater than six feet and the distance between the centerlines of the first and third columns is greater than six feet.

5. The cooling tower of claim 1 further including a base on which one end of each column is supported, the first and second columns having upper ends above the beam, at least part of the fluid distribution system being positioned between a lower horizontal plane through the beam and an upper horizontal plane through the upper ends of the first and second columns, the beam and the first and second columns being free from diagonal cross-bracing between the upper and lower horizontal planes.

6. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

a first joint comprising:

mounting surfaces on the first column and the beam;

a first mounting member having a mounting surface facing the mounting surfaces of the first column and the beam;

a mechanical fastener extending from the first mounting member to the first column;

a mechanical fastener extending from the first mounting member to the beam; and bonding material disposed between the mounting surfaces of the first column and first mounting member and between the mounting surfaces of the beam and first mounting member;

a second joint comprising:

mounting surfaces on the second column and the beam;

a second mounting member having a mounting surface facing the mounting surfaces of the second column and the beam;

a mechanical fastener extending from the second mounting member to the second column;

a mechanical fastener extending from the second mounting member to the beam; and bonding material disposed between the mounting surfaces of the second column and second mounting member and between the mounting surfaces of the beam and second mounting member;

wherein the first and second mounting members are free from any connection to a diagonal cross-brace; and wherein at a plurality of loads including the design dead load and a higher load, the amount of any deflection of at least one of the frame members is within +/−10% of the amount of deflection of a model beam with moment-transferring joints.

7. The cooling tower of claim 6 wherein the mounting surfaces of the beam, the first and second columns and first and second mounting members are substantially vertical and wherein the plurality of frame members further includes a second beam and a third column, the first and second beams being substantially horizontal and substantially perpendicular to each other, the second beam extending between the first column and the third column, the cooling tower further including:

a third joint comprising:

substantially vertical mounting surfaces on the second beam and the third column;

a third mounting member having a substantially vertical mounting surface facing the mounting surfaces of the third column and the second beam;

a mechanical fastener extending from the third mounting member to the third column;

a mechanical fastener extending from the third mounting member to the second beam; and bonding material disposed between the mounting surfaces of the third column and third mounting member and between the mounting surfaces of the second beam and third mounting member;

a fourth joint comprising:

a substantially vertical mounting surface on the second beam and an additional substantially vertical mounting surface on the first column, the additional mounting surface of the first column being substantially perpendicular to the mounting surface of the first column at the first joint;

a fourth mounting member having a substantially vertical mounting surface substantially perpendicular to the mounting surface of the first mounting member and facing the mounting surface of the second beam and the additional mounting surface of the first column;

a mechanical fastener extending from the fourth mounting member to the first column;

a mechanical fastener extending from the fourth mounting member to the second beam; and bonding material disposed between the mounting surface of the fourth mounting member and the additional mounting surface of the first column and between the mounting surfaces of the second beam and fourth mounting member;

wherein at a plurality of loads including the design dead load and a higher load, the amount of any deflection of at least one of the first and second beam is within +/−10% of the amount of deflection of a model beam with moment-transferring joints.

8. The cooling tower of claim 7 wherein the distance between the centerlines of the first and second columns is greater than four feet and the distance between the centerlines of the first and third columns is greater than four feet.

9. The cooling tower of claim 8 wherein the distance between the centerlines of the first and second columns is greater than six feet and the distance between the centerlines of the first and third columns is greater than six feet.

10. The cooling tower of claim 6 further including a base on which one end of each column is supported, the first and second columns having upper ends above the beam, at least part of the fluid distribution system being positioned between a lower horizontal plane through the beam and an upper horizontal plane through the upper ends of the first and second columns, the beams and the first and second columns being free from diagonal cross-bracing between the upper and lower horizontal planes.

11. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

a first joint comprising:

mounting surfaces on the first column and the beam;

a first mounting member having a mounting surface facing the mounting surfaces of the first column and the beam;

a mechanical fastener extending from the first mounting member to the first column;

a mechanical fastener extending from the first mounting member to the beam; and bonding material disposed between the mounting surfaces of the first column and first mounting member and between the mounting surfaces of the beam and first mounting member;

a second joint comprising:

mounting surfaces on the second column and the beam;

a second mounting member having a mounting surface facing the mounting surfaces of the second column and the beam;

a mechanical fastener extending from the second mounting member to the second column;

a mechanical fastener extending from the second mounting member to the beam; and bonding material disposed between the mounting surfaces of the second column and second mounting member and between the mounting surfaces of the beam and second mounting member;

wherein the first and second mounting members are free from connection to any diagonal cross-brace and wherein the joints have design moment capacities at least as great as the anticipated moments.

12. The cooling tower of claim 11 wherein the joints have design moment capacities greater than the anticipated moments.

13. The cooling tower of claim 11 further including a base on which one end of each column is supported, the first and second columns having upper ends above the beam, at least part of the fluid distribution system being positioned between a lower horizontal plane through the beam and an upper horizontal plane through the upper ends of the first and second columns, the beams and the first and second columns being free from diagonal cross-bracing between the upper and lower horizontal planes.

14. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

the first and second columns and the beam having mounting surfaces;

first and second mounting members, the first mounting member having a mounting surface facing the mounting surfaces of the beam and the first column and the second mounting member having a mounting surface facing the mounting surfaces of the beam and the second column;

a plurality of mechanical fasteners, at least one mechanical fastener extending from each mounting member to the adjacent column, at least one mechanical fastener extending from each mounting member to the beam; and bonding material disposed between the mounting surfaces of the mounting members and the mounting surfaces of the columns and beam;

wherein at least one of the mounting members is selected from the group consisting of plates including fiber reinforced material having a thickness greater than one-eighth inch and plates including a metal.

15. The cooling tower of claim 14 wherein the mounting members at both ends of the beam are free from connection to any diagonal cross-brace.

16. The cooling tower of claim 14 wherein the mounting surfaces of the beam, the columns and mounting members are substantially vertical, the cooling tower further including a base on which one end of each column is supported, the first and second columns having upper ends above the beam, at least part of the fluid distribution system being positioned between a lower horizontal plane through the beam and an upper horizontal plane through the upper ends of the first and second columns, the beam and the first and second columns being free from diagonal cross-bracing between the upper and lower horizontal planes.

17. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

the first and second columns and the beam having mounting surfaces;

first and second mounting members, the first mounting member having a mounting surface facing the mounting surfaces of the beam and the first column and the second mounting member having a mounting surface facing the mounting surfaces of the beam and the second column;

a plurality of mechanical fasteners, at least one mechanical fastener extending from each mounting member to the adjacent column, at least one mechanical fastener extending from each mounting member to the beam; and bonding material disposed between the mounting surfaces of the mounting members and the mounting surfaces of the columns and beam;

wherein at least one mounting member has a shear strength greater than 2500 pounds per square inch.

18. The cooling tower of claim 17 wherein the mounting members at both ends of the beam are free from connection to any diagonal cross-brace.

19. The cooling tower of claim 17 wherein the mounting surfaces of the beam, the columns and mounting members are substantially vertical, the cooling tower further including a base on which one end of each column is supported, the first and second columns having upper ends above the beam, at least part of the fluid distribution system being positioned between a lower horizontal plane through the beam and an upper horizontal plane through the upper ends of the first and second columns, the beam and the first and second columns being free from diagonal cross-bracing between the upper and lower horizontal planes.

20. A cooling tower comprising:

a plurality of frame members made of a fiber reinforced material and including a first column, a second column and a beam extending between the first and second columns;

a fluid distribution system for distributing fluid within the cooling tower;

heat transfer material through which air and fluid from the fluid distribution system may pass;

the first and second columns and the beam having mounting surfaces;

first and second mounting members, the first mounting member having a mounting surface facing the mounting surfaces of the beam and the first column and the second mounting member having a mounting surface facing the mounting surfaces of the beam and the second column;

a plurality of mechanical fasteners, at least one mechanical fastener extending from each mounting member to the first column, at least one mechanical fastener extending from each mounting member to the beam; and bonding material disposed between the mounting surfaces of the mounting members and the mounting surfaces of the columns and beam;

wherein at least one of the mounting members has a modulus of elasticity greater than $1\times10^6$ pounds per square inch.

21. The cooling tower of claim 20 wherein the mounting members at both ends of the beam are free from connection to any diagonal cross-brace.

22. The cooling tower of claim 20 wherein the mounting surfaces of the beam, the columns and the mounting members are substantially vertical, the cooling tower further including a base on which one end of each column is supported, the first and second columns having upper ends above the beam, at least part of the fluid distribution system being positioned between a lower horizontal plane through the beam and an upper horizontal plane through the upper ends of the first and second columns, the first and second columns being free from diagonal cross-bracing between the upper and lower horizontal planes.

* * * * *